US012343655B2

(12) United States Patent
Stark

(10) Patent No.: US 12,343,655 B2
(45) Date of Patent: Jul. 1, 2025

(54) FLYING DISCS INCLUDING STRUCTURES EXTENDING FROM UNDERNEATH THE DISCS

(71) Applicant: Steven Patrick Stark, Plymouth, MN (US)

(72) Inventor: Steven Patrick Stark, Plymouth, MN (US)

( * ) Notice: Subject to any disclaimer, the term of this patent is extended or adjusted under 35 U.S.C. 154(b) by 244 days.

(21) Appl. No.: 17/859,728

(22) Filed: Jul. 7, 2022

(65) Prior Publication Data

US 2023/0090692 A1 Mar. 23, 2023

Related U.S. Application Data

(60) Provisional application No. 63/360,474, filed on Oct. 5, 2021, provisional application No. 63/360,272, filed on Sep. 20, 2021.

(51) Int. Cl.
*A63H 33/18* (2006.01)

(52) U.S. Cl.
CPC ..... *A63H 33/18* (2013.01)

(58) Field of Classification Search
CPC ..... A63H 33/18
See application file for complete search history.

(56) References Cited

U.S. PATENT DOCUMENTS

| | | | | |
|---|---|---|---|---|
| 3,673,731 A | | 7/1972 | Farhi et al. | |
| 3,828,466 A | * | 8/1974 | Geiger | A63H 33/18 473/589 |
| 4,205,484 A | | 6/1980 | Kovac et al. | |
| 4,255,893 A | * | 3/1981 | Anderson | A63H 33/18 473/588 |
| 4,370,824 A | * | 2/1983 | Resnicow | A63H 33/18 473/588 |
| D295,429 S | | 4/1988 | Sandeen | |
| 4,869,699 A | | 9/1989 | Plambeck et al. | |
| 4,940,441 A | | 7/1990 | Novinsky | |
| 5,067,923 A | * | 11/1991 | de Bourbon | A63H 33/18 473/588 |
| 5,181,876 A | | 1/1993 | Chen et al. | |
| 5,319,531 A | | 6/1994 | Kutnyak | |
| 7,294,036 B2 | | 11/2007 | Potts | |
| 9,039,479 B1 | | 5/2015 | Green | |
| 2009/0176435 A1 | * | 7/2009 | Stark | A63H 33/18 446/46 |

* cited by examiner

*Primary Examiner* — John A Ricci
(74) *Attorney, Agent, or Firm* — Edlavitch Law PLLC

(57) ABSTRACT

Described herein are novel technologies that improve various aspects of flying discs. In some embodiments, an apparatus includes a disc having a bottom structure and an upstanding edge included with and circumscribing the bottom structure to form a recess. And, the apparatus also includes an inner central structure underneath the bottom structure at a central portion of the disc. The apparatus or at least part of the apparatus can be plastic or foam and can include rubber components that make it easier to grip. The apparatus can include a thumb ring underneath the bottom structure and within the inner central structure. And, for example, the thumb ring can include rubber to make the apparatus easier to grip.

20 Claims, 25 Drawing Sheets

FIG. 13
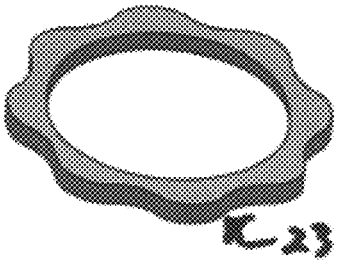
FIG. 14
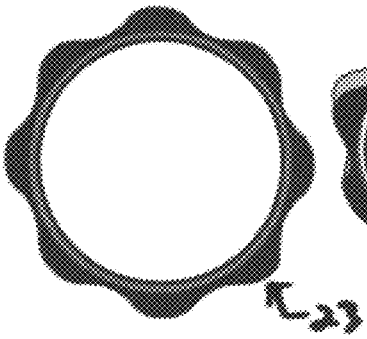
FIG. 15
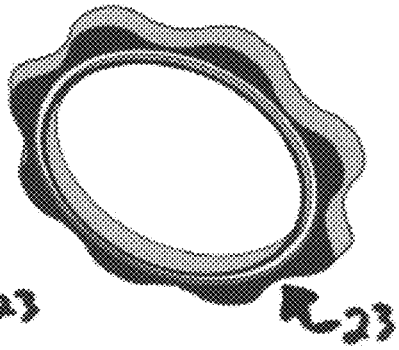
FIG. 16
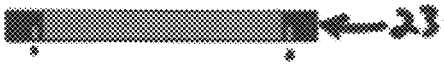
FIG. 17
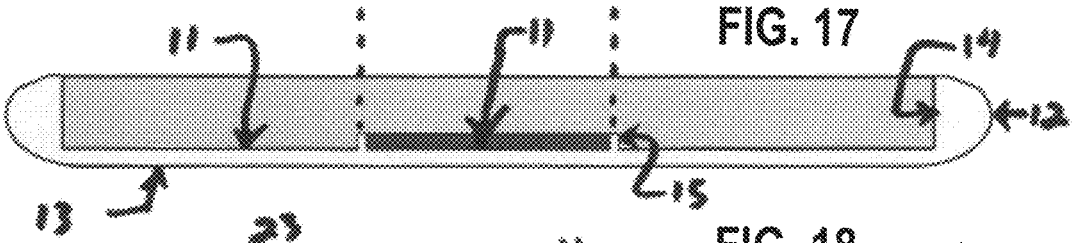
FIG. 18
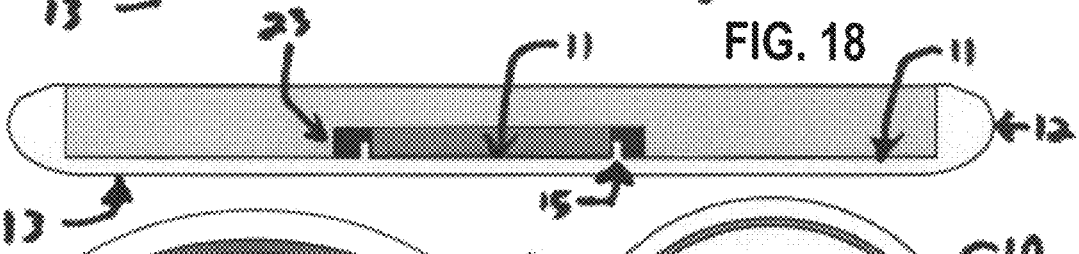
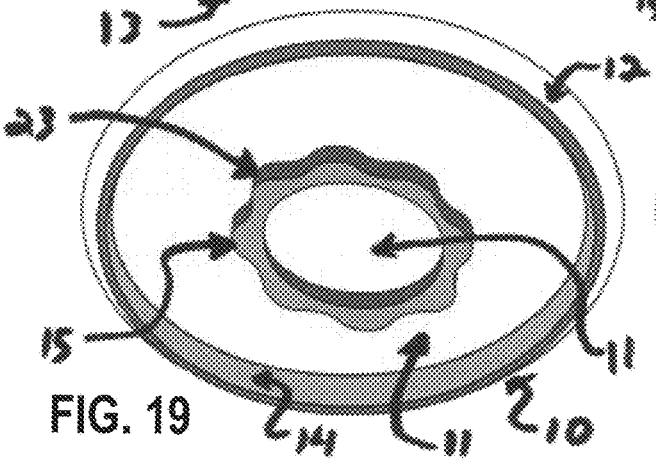
FIG. 19
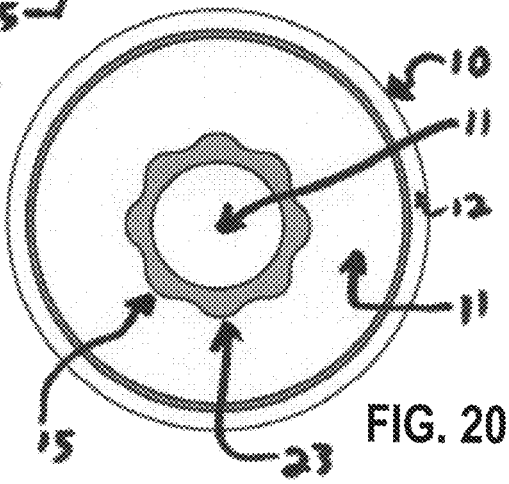
FIG. 20

FIG. 25
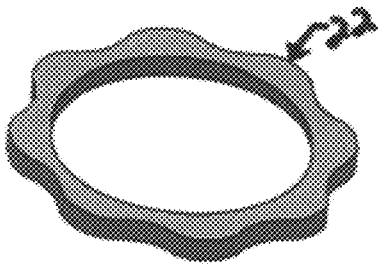
FIG. 26
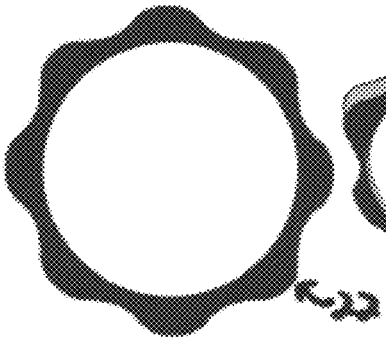
FIG. 27
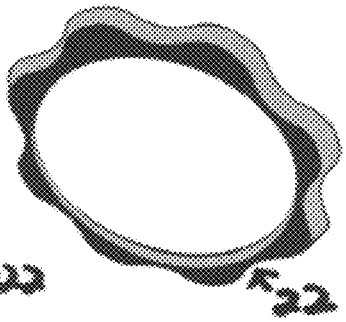
FIG. 28
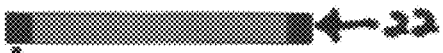
FIG. 29
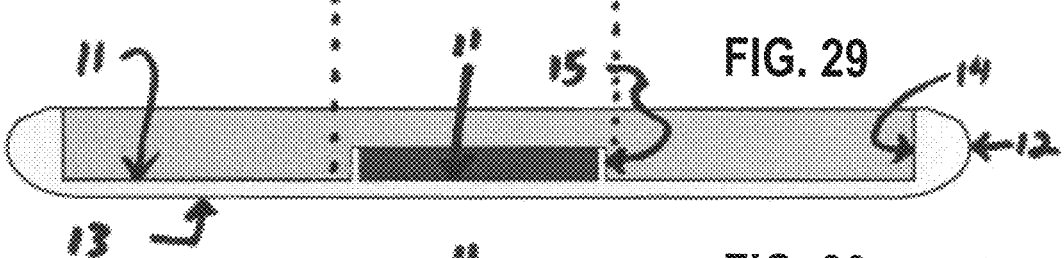
FIG. 30
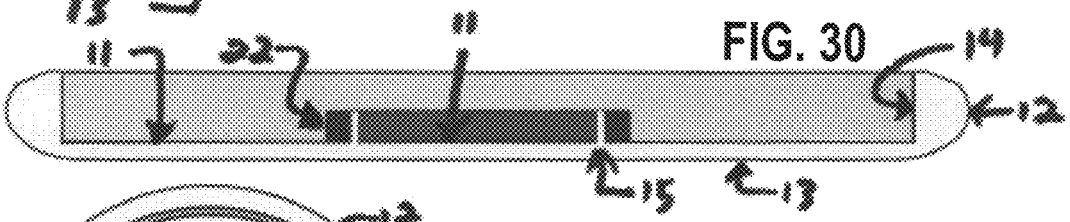
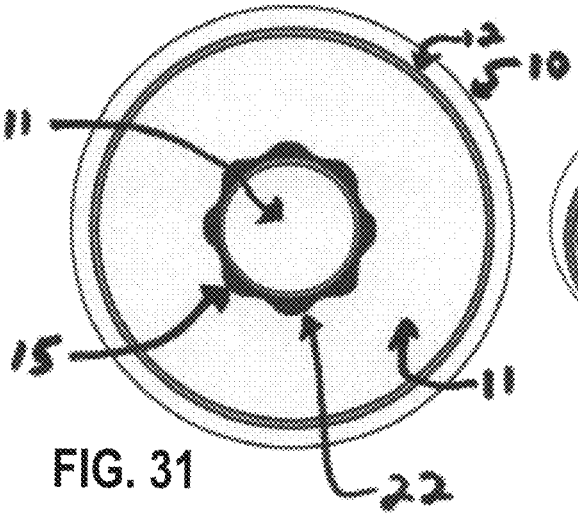
FIG. 31
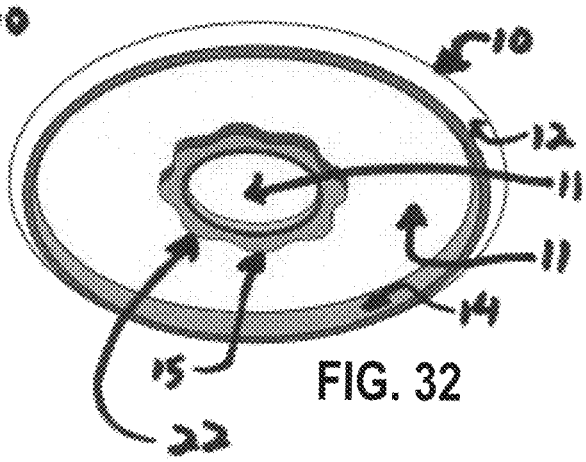
FIG. 32

FIG. 46
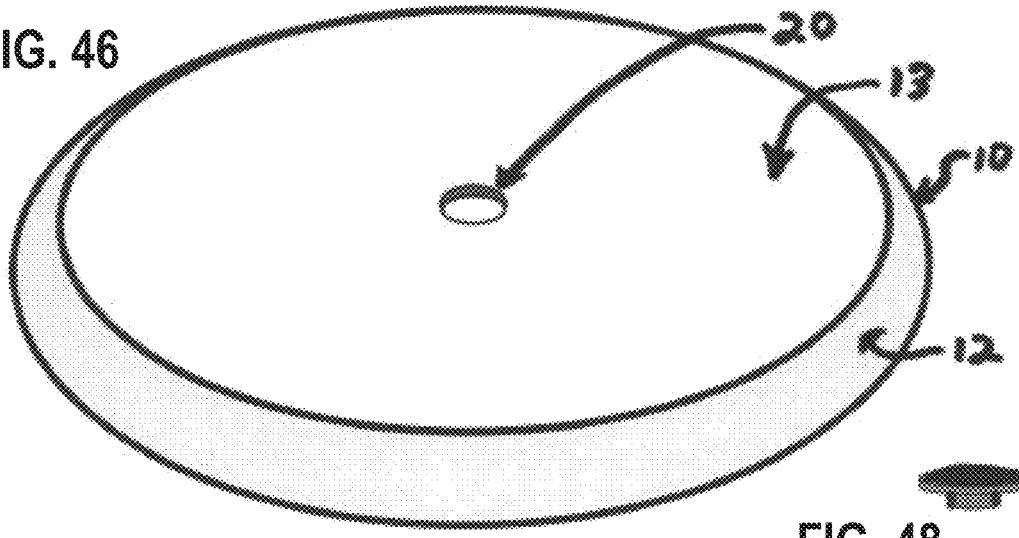
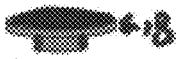
FIG. 48
FIG. 47
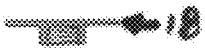
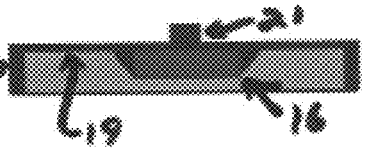
FIG. 49
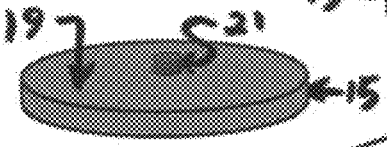
FIG. 50
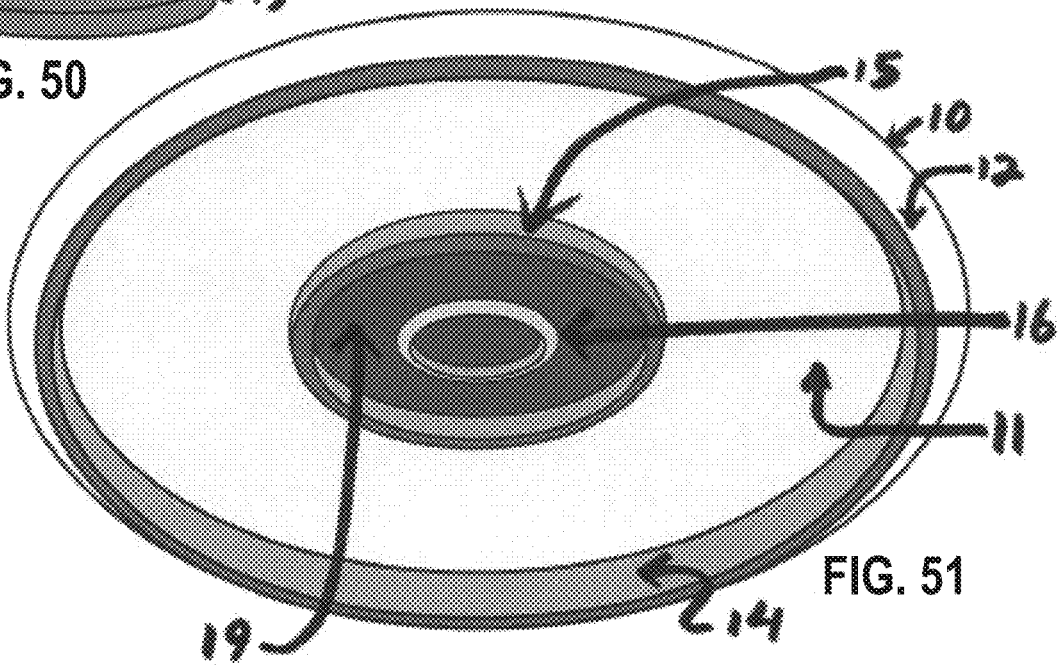
FIG. 51

FIG. 52
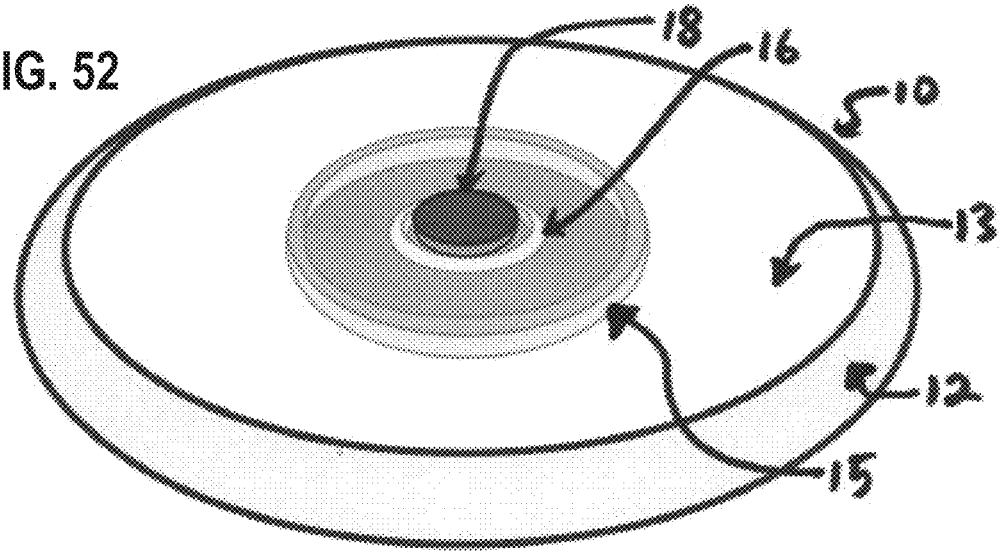
FIG. 53
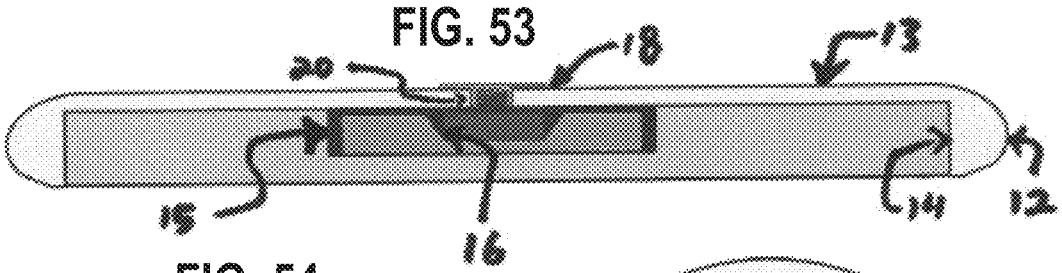
FIG. 54
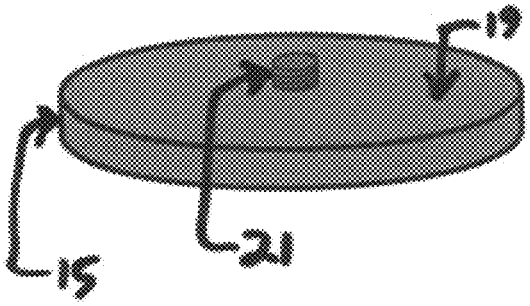
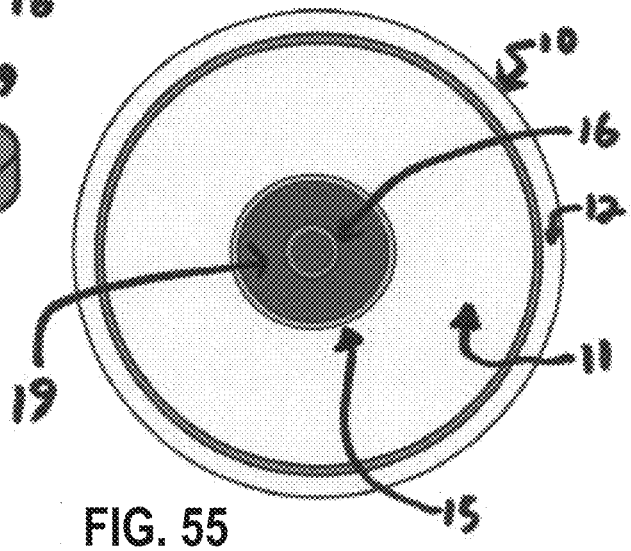
FIG. 55

FIG. 56
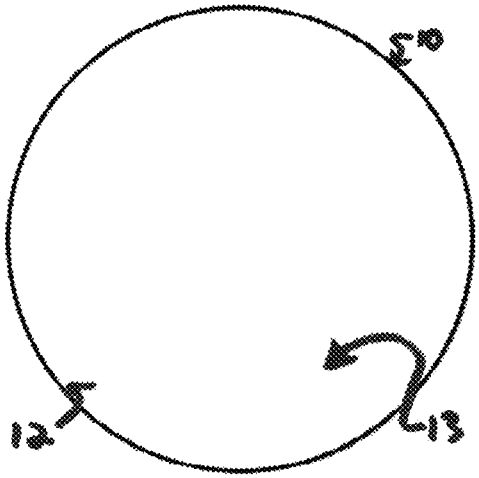
FIG. 57
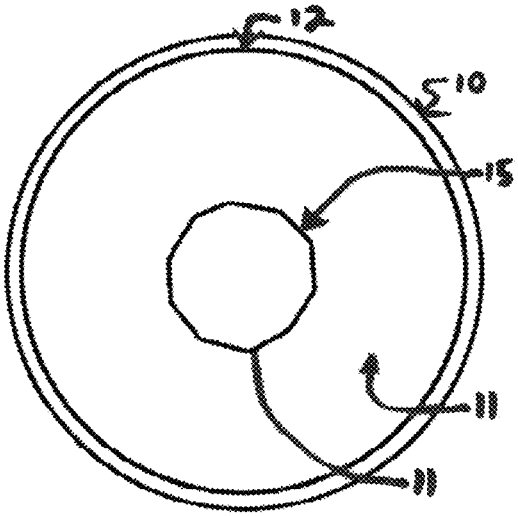
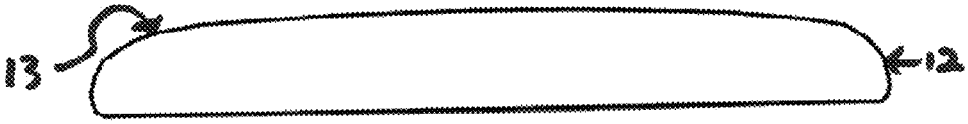
FIG. 58
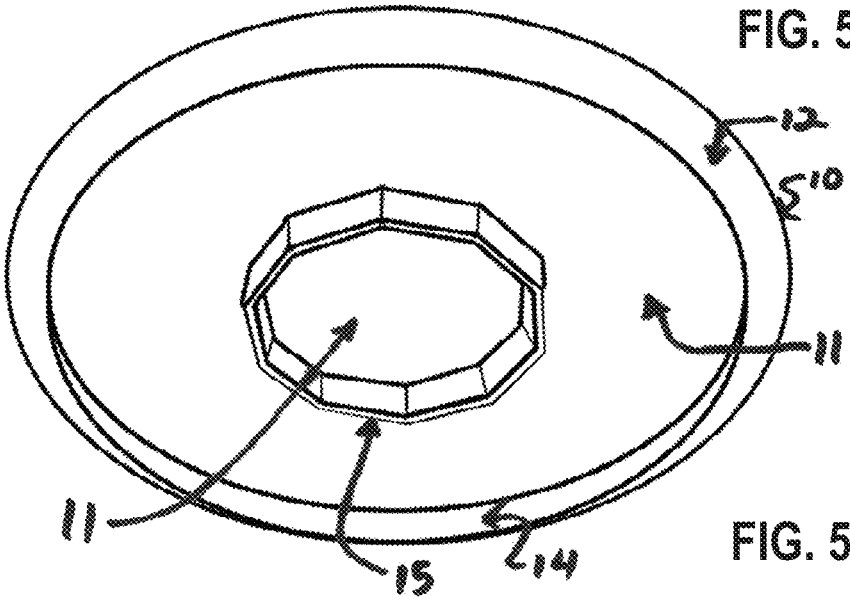
FIG. 59

FLYING DISCS INCLUDING STRUCTURES EXTENDING FROM UNDERNEATH THE DISCS

CROSS-REFERENCE TO RELATED APPLICATIONS

This application claims the benefit of priority from Prov. U.S. Pat. App. Ser. No. 63/360,272, filed Sep. 20, 2021, which is incorporated herein by reference in its entirety, and from Prov. U.S. Pat. App. Ser. No. 63/360,474, filed Oct. 5, 2021, which is incorporated herein by reference in its entirety.

TECHNICAL FIELD

The present disclosure relates to flying discs including structures extending from underneath the discs.

BACKGROUND

The application of a flying discs has been widely accepted, both as an active leisure pastime and as in disc golf. It is widely understood that flying discs are designed for the launching of the discs from the side of the flying disc and the use of the exterior rim for gripping of the flying discs. Individuals can have varied results with throwing such discs and are prone to have slight issues with release timing, direction, and spin. Beginners to well-seasoned disc golf professionals can have issues, as it is not like throwing a ball. Thus, such discs would benefit from having news ways of being thrown to improve launch ease and accuracy.

Also, individual launch flying discs from different angles, such as a raised arm, to more accurately launch a flying disc into a straighter line for being received by a catcher or disc golf basket. Also, when one is using a flying disc in the water, a swimming action and body position in general does not allow an individual the normal angles and ability to successfully launch the disc as one would normally do when launching the disc from the side of the flying disc and exterior rim grip.

Giving anyone more controlled accuracy in a desired direction or flight for launching of discs is beneficial for recreation, disc golf beginner, or a disc golf professional. Previous attempts to create flying discs have been primarily focused on improved aerodynamics for distance or side gripping. It has been discovered there is more of a need or desire to create a flying disc that can be easily launched and in a more controllable with respect to launch direction and flight by a recreational player, a beginner disc golf player, or a professional disc golf player. Disc golf flying discs largely resemble each other including the smaller putter flying disc. The putter flying disc can be used when in close proximity of the target. The disc golf putter flying disc should be designed for fairly short distance use and it can provide the most accurate direction of travel to get it into the disc golf basket or target. However, such discs appear to have the relative same physical attributes designed for the same similar launching throwing techniques as the longer flying distance driver or mid-range distance disc golf flying discs. Creating a disc golf flying disc putter one may prefer if the travel of the flying disc was reduced (e.g., reduced aerodynamics) so if one misses the target the flying disc putter does not travel far from the target. Currently one disc golf disc designed for distance closely resembles another designed for short distance (e.g., the disc golf putter).

SUMMARY

Described herein are novel technologies that improve various aspects of a flying discs and provide specific solutions to at least overcome the problems mentioned in the background section or other parts of the application as well as other problems not described herein but recognized by those skilled in the art.

In some embodiments, the technologies described herein provide a flying disc having a bottom structure and an upstanding edge connected to and circumscribing the bottom structure to form a recess. The structure, in some examples described herein, is referred to as a flight plate or a plate. In some embodiments, the flying disc additionally includes inner central areas that form a ring or symmetrical ring like structures protruding from the recessed bottom flight plate (such as included underneath the plate). The ring or the symmetrical ring like structures facilitates the gripping of the flying disc from under the flying disc. In some embodiments, the symmetrical ring like structures include edging, texture, recesses, tabs, posts, curves, ribbing, the like, or any combination thereof to improve grip and assist in easier rotation of the flying disc during launch. The structures can vary greatly in shape and size, e.g., the structures can have different sizes, different thicknesses, heights, and diameters. These different versions can be beneficial for different hand sizes and flying disc sizes.

In some examples, the disc includes, such as being included underneath the plate, rings or ring like symmetrical structures created for improved reduction of flight aerodynamics and improved flying disc stabilization and ease of launch (e.g., the disc can include rings, edging, texture, tabs, posts, curves, ribbing, etc.). In some embodiments, flight stabilizing members are disposed on the bottom flight plate structure (such as underneath the plate). Some embodiments provide different ways for throwing a flying disc. Such examples includes providing a flying disc having an upstanding ring or ring like symmetrical structures located in central areas of the flight plate bottom with extended areas that can resemble ridges or can be ribbed or curved or can include texture, edging, tabs, posts, or the like, or some combination thereof.

Some embodiments provide easy gripping and rotational throwing of the flying disc in a more accurate way. Some embodiments can also include flight stabilizing members disposed on the bottom flight plate structure (such as underneath the plate). In a foam type flying disc embodiment, the disc can incorporate a centered inner durable flying disc device that is centrally located and secures between top and bottom of the plate.

Some embodiments provide additional ways for throwing a flying disc. The ways include a flying disc having an upstanding edge connected to a flight plate bottom structure where it is protruding from the bottom flight plate (such as from underneath the plate) and is a centrally located small inner molded ring rim that one could place a thumb and provide resistance when holding the edge of the flying disc with fingers simultaneously. Such embodiments can be grooved, ribbed, or textured to enhance thumb grip. Such a grip of the flying disc with the molded central location rim thumb ring included to allow gripping and rotation of the flying disc around a thumb. In some examples, manufacturing can create various flying discs to accommodate different skill levels of throwers, such as by modifying the diameter size, thickness, and height. In some examples, using one hand, the resistance from the center of the flying disc from the thumb placement within the molded center rim thumb ring and fingers on the flying disc outer edge creates a typical grip of the flying disc. In such examples and others, the rotation of a flying disc spin comes from the fingers rotating the flying disc upon the thumb recessed within the molded center rim thumb ring with a snap of the wrist and follow through of the thumb in a direction of attempted flying disc travel direction.

These and other important aspects of the invention are described more fully in the detailed description below. The invention is not limited to the particular methods and systems described herein. Other embodiments can be used and changes to the described embodiments can be made without departing from the scope of the claims that follow the detailed description.

BRIEF DESCRIPTION OF THE DRAWINGS

The present disclosure will be understood more fully from the detailed description given below and from the accompanying drawings of various embodiments of the disclosure.

FIG. 13 depicts a perspective view of enhanced grip ring cover, in accordance with some embodiments of the present disclosure.

FIG. 14 depicts another view of the enhanced grip ring cover, in accordance with some embodiments of the present disclosure. This shows the indented area of the enhanced grip ring cover to attach to the molded grip ring under the flying disc bottom flight plate.

FIG. 15 depicts a perspective view of the enhanced grip ring cover, in accordance with some embodiments of the present disclosure. This shows the indented area of the enhanced grip ring cover to attach to the molded grip ring under the flying disc bottom flight plate.

FIG. 16 depicts a side cross-sectional view of the enhanced grip ring cover, in accordance with some embodiments of the present disclosure. This shows the indented area of the enhanced grip ring cover to attach to the molded grip ring under the flying disc bottom flight plate.

FIG. 17 depicts a side cross-sectional view of the flying disc with a single grip ring, in accordance with some embodiments of the present disclosure. This upside down view of the flying disc shows the dotted line of how the enhanced grip ring cover attaches to the molded grip ring on the underside of the flying disc flight plate.

FIG. 18 depicts a side cross-sectional view of the flying disc with a single grip ring, in accordance with some embodiments of the present disclosure. This upside down view of the flying disc with a single grip ring has the enhanced grip ring cover attached and secured together.

FIG. 19 depicts a perspective view showing underneath the disc and the enhanced grip ring cover attached to the single grip ring located centrally under the flying disc flight plate, in accordance with some embodiments of the present disclosure.

FIG. 20 depicts a bottom view of the flying disc showing the enhanced grip ring cover attached to the single grip ring, in accordance with some embodiments of the present disclosure.

FIG. 25 depicts a perspective view of the enhanced grip ring, in accordance with some embodiments of the present disclosure.

FIG. 26 depicts a bottom view of the enhanced grip ring, in accordance with some embodiments of the present disclosure.

FIG. 27 depicts a perspective view of the bottom of the enhanced grip ring, in accordance with some embodiments of the present disclosure.

FIG. 28 depicts a side cross-sectional view of the enhanced grip ring, in accordance with some embodiments of the present disclosure.

FIG. 29 depicts a side cross-sectional view of the flying disc upside down showing a single grip ring, in accordance with some embodiments of the present disclosure. This illustrates a larger in height grip ring extending from the bottom of the flying disc flight plate.

FIG. 30 depicts a side cross-sectional view of the enhanced grip ring attached and secured to the single flying disc grip ring that is molded to the flying disc bottom flight plate, in accordance with some embodiments of the present disclosure.

FIG. 31 depicts a bottom view of the flying disc with grip ring having the enhanced grip ring attached and secured to it, in accordance with some embodiments of the present disclosure.

FIG. 32 depicts a perspective view of the bottom of the flying disc showing the enhanced grip ring attached and secured around the single flying disc grip ring, in accordance with some embodiments of the present disclosure.

FIG. 46 depicts a perspective view of a top of foam type flying disc with hole in the center of the flying disc, in accordance with some embodiments of the present disclosure. This hole can be slotted or geared to resist the centered inner durable flying disc device rotation that is to be placed within it and not spin within the flying disc. It is common for the flying disc turns with the centered inner durable flying disc device when rotated from below the flying disc. The centered inner durable flying disc device can also be secured by other methods such as the two pieces being clipped together through this hole or glued.

FIG. 47 depicts a cross-section view of top cap retainer cover of inner durable flying disc device that features a female screw created within the bottom area, in accordance with some embodiments of the present disclosure. The outside area of the female screw structure can be slotted or gear type exterior to ensure flying disc rotation when inner durable flying disc device is being rotated.

FIG. 48 depicts a perspective view of top cap retainer cover of inner durable flying disc device, in accordance with some embodiments of the present disclosure.

FIG. 49 depicts a side cross-sectional view of bottom inner durable flying disc device that features molded center rim thumb ring and grip ring (larger circle).

FIG. 50 depicts a perspective view of a top of the bottom inner durable flying disc device, in accordance with some embodiments of the present disclosure. This also illustrates the grip ring structure however enhanced structures can also be incorporated to facilitate easier handling and control, gripping and rotation of the flying disc.

FIG. 51 depicts a perspective view of the bottom of a foam type flying disc featuring attached inner durable flying disc device that is secured into the center bottom of a flying disc flight plate, in accordance with some embodiments of the present disclosure.

FIG. 52 depicts a perspective view of the top of a see-through foam type flying disc, in accordance with some embodiments of the present disclosure. The inner durable flying disc device is assembled and secured into the center of the foam type flying disc. The top cap cover of the flying disc inner durable flying disc device that is centered on top of the flying disc flight plate. Top cap cover is attached via screw type connection to the bottom inner durable flying disc device that features the molded center rim thumb ring and grip ring (larger circle). These two pieces of inner durable flying disc device sandwich the top and bottom flying disc flight plate.

FIG. 53 depicts a side cross-sectional view of the foam type flying disc with assembled centered inner durable flying disc device, in accordance with some embodiments of the present disclosure. The bottom of the centered inner durable flying disc device illustrates it as being secured flatly to the flying disc bottom flight plate and it can be useful to have a portion near the edge of the grip ring be elevated from bottom of a flying disc flight plate. This can facilitate better gripping ability and reducing the height of the grip ring needed for gripping.

FIG. 54 depicts a perspective view of the top of the bottom inner durable flying disc device, in accordance with some embodiments of the present disclosure. The molded male screw connecting element rising from the centered area. This shows an enlarged view for detail and can incorporate a stepped profile or angle of bottom of a flying disc flight plate to provide easier gripping of the grip ring.

FIG. 55 depicts a bottom view of foam type flying disc featuring centered inner durable flying disc device assembled and features the bottom view of the attached and secured centered inner durable flying disc device, in accordance with some embodiments of the present disclosure. This features the molded center rim thumb ring and grip ring (larger circle).

FIG. 56 depicts a top perspective view of a 3D flying disc, in accordance with some embodiments of the present disclosure.

FIG. 57 depicts a bottom perspective view of a 3D flying disc featuring straight edged grip ring, in accordance with some embodiments of the present disclosure.

FIG. 58 depicts a side perspective view of a 3D flying disc, in accordance with some embodiments of the present disclosure.

FIG. 59 depicts a perspective view of the bottom of a 3D flying disc featuring straight edged grip ring, in accordance with some embodiments of the present disclosure.

DETAILED DESCRIPTION OF EXAMPLE EMBODIMENTS

Figure 1:
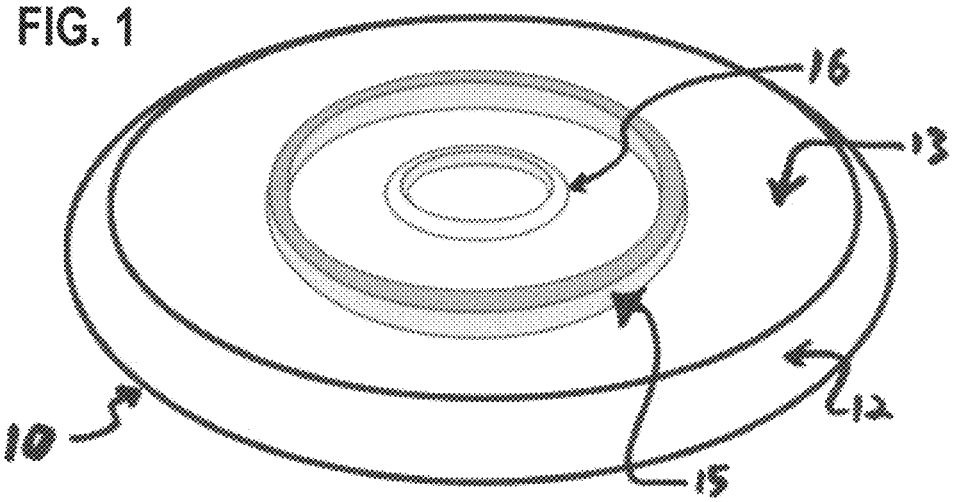
FIG. 1 depicts a perspective view of a top portion of a flying disc showing a molded center rim thumb ring and a grip ring (larger ring) seen on the underside of the flying disc, in accordance with some embodiments of the present disclosure.
Figure 2:
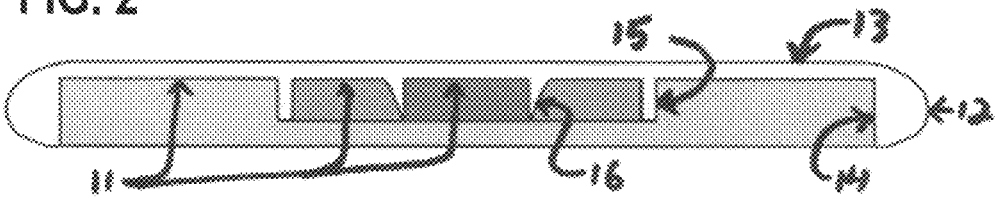
FIG. 2 depicts a side cross-sectional view of a flying disc and a molded center rim thumb ring and grip ring (large circle) seen coming from the bottom flight plate under the flying disc, in accordance with some embodiments of the present disclosure.

In the description herein, numerous specific details are provided, such as examples of components or methods, to provide a thorough understanding of the embodiments of the present invention. One skilled in the relevant art will recognize, however, that an embodiment of the invention may be practiced without one or more of the specific details, or with other apparatus, systems, assemblies, methods, components, materials, parts, or the like. In other instances, well-known structures, materials, or operations are not specifically shown or described in detail to avoid obscuring aspects of the embodiments of the present invention.

In reference to and with respect to at least some of the drawings mentioned in the section of this disclosure titled "Brief Description of the Drawings" and some embodiments of the invention, the description herein includes a flying disc which can be implemented in various ways, but is illustrated as flying disc 10 in this disclosure. The flying disc 10 has a bottom flight plate structure 11 and an upstanding edge 12 (e.g., a curved saucer-like contour edge) integrally coupled to the top flight plate structure 13. In some embodiments, the upstanding edge 12 is thicker than the flight plate structures 11 and 13. The flying disc 10 (e.g., including the upstanding edge 12 and the bottom and top plate structures 11 and 13) can be manufactured from any suitable material, such as a resilient synthetic molded material composite, e.g., including foam, rubber, plastic or plastic like durable molded material, or any combination thereof.

Figure 3:
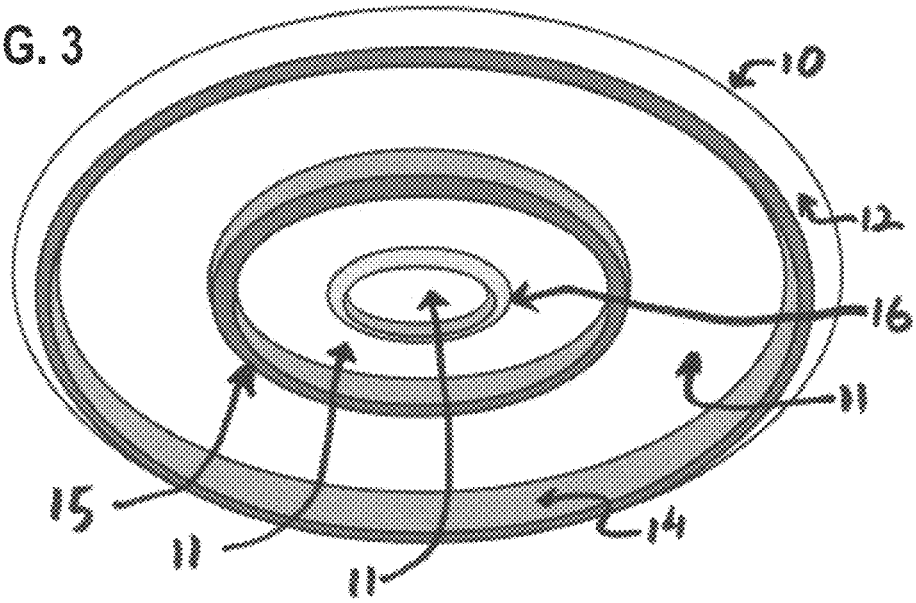
FIG. 3 depicts a perspective view of underneath a flying disc showing a molded center rim thumb ring and grip ring (larger circle) coming from a bottom of flight plate under the flying disc, in accordance with some embodiments of the present disclosure.
Figure 4:
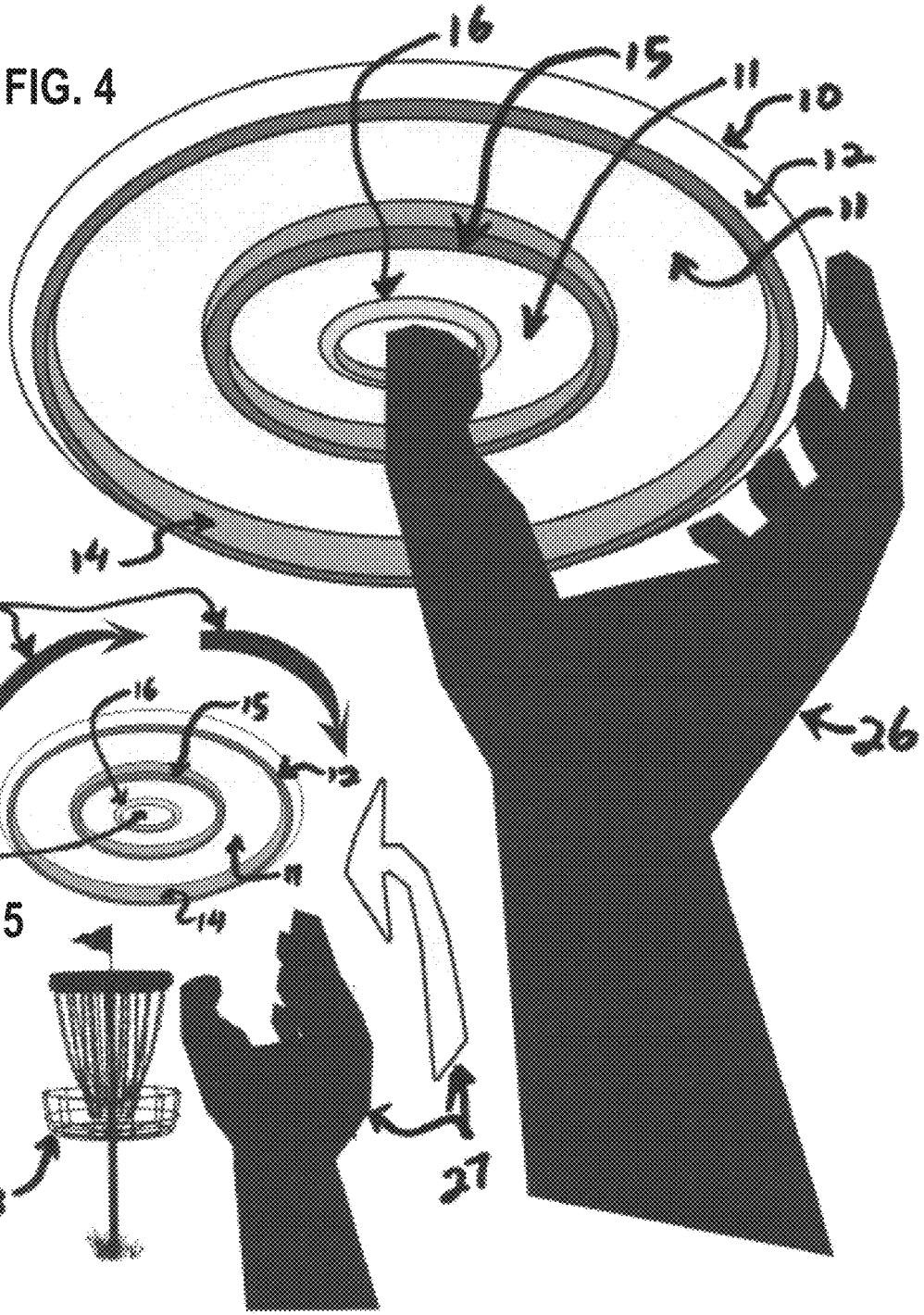
FIG. 4 depicts a perspective view showing a molded center rim thumb ring and a grip ring (larger circle), in accordance with some embodiments of the present disclosure. This shows a hand holding the flying disc where the thumb is resting in the molded center rim thumb ring with side wall pressure being applied on that molded center rim thumb ring while the fingers are holding the outside edge of the flying disc with equal pressure. This allows one to secure and control the ability to hold and launch a flying disc with this utility grip.
Figure 5:
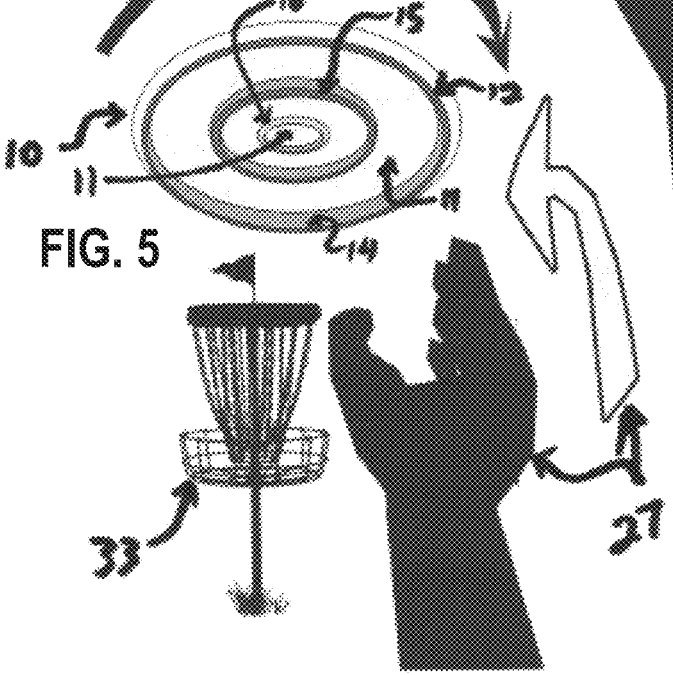
FIG. 5 depicts a release of the flying disc with a forward motion of the arm and the spin of the flying disc off the thumb within center rim pressure ring in a direction as the fingers moved forward on the flying disc creating spin and thumb release in a direction of travel, in accordance with some embodiments of the present disclosure. The flying disc moves directly at the flying disc target or in a direction intended by the thrower. This would be reversed for left-handed flying disc throwers.

In some embodiments, the bottom flight plate structure 11 and the upstanding edge 12 form a circular recess 14 connecting to the bottom flight plate structure 11, with a centrally disposed grip ring (e.g., or raised structure from plate structure 11), illustrated as grip ring 15. In one embodiment, and as shown in FIG. 3, a small grip ring rises from the bottom flight plate structure 11 for thumb placement on the thumb ring 16 that is illustrated in FIG. 4. This shows the hand 26 gripping of the flying disc from the thumb ring 16 and the fingers grabbing the exterior of the flying disc with pressure (e.g., grabbing the upstanding edge 12). Launching of the flying disc with forward arm motion 27 and the finger rotating the upstanding edge 12 of the flying disc and launching the spinning motion of the flying disc 10 and the thumb (e.g., release of a flying disc 10), in FIG. 5, leaving the thumb ring 16 in an intended direction of the flying disc flight target 33. The flying disc 10 and launching the spinning motion of the flying disc 28 in the accurate and intended direction of the flying disc 10 and target 33.

Figure 6:
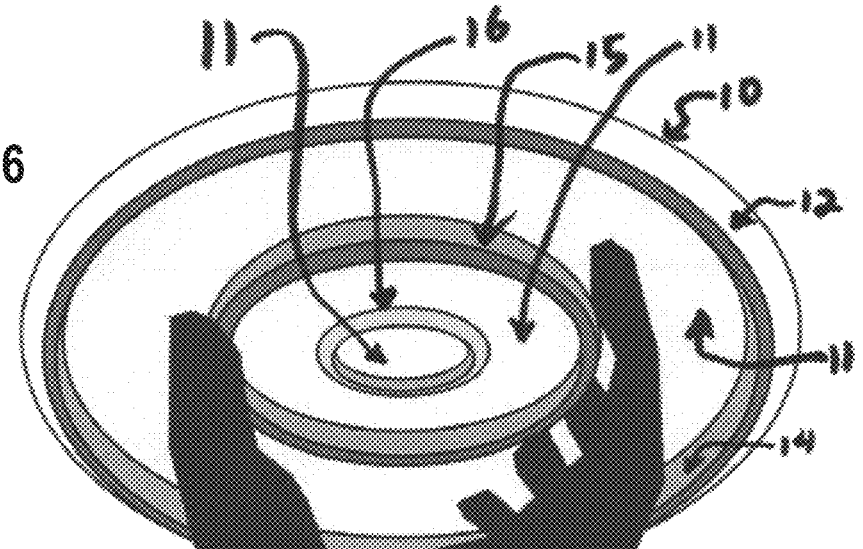
FIG. 6 depicts a perspective view of the flying disc showing the molded centered rim thumb ring and grip ring (larger circle), in accordance with some embodiments of the present disclosure. This shows a hand holding the flying disc with the grip ring (larger circle). This facilitates the controlled grip of the flying disc from under the flying disc flight plate. Some embodiments of the grip rings will be highlighted herein. Some grip rings provide easier gripping and rotational gripping elements conducive to creating spin during launch of the flying disc.
Figure 7:
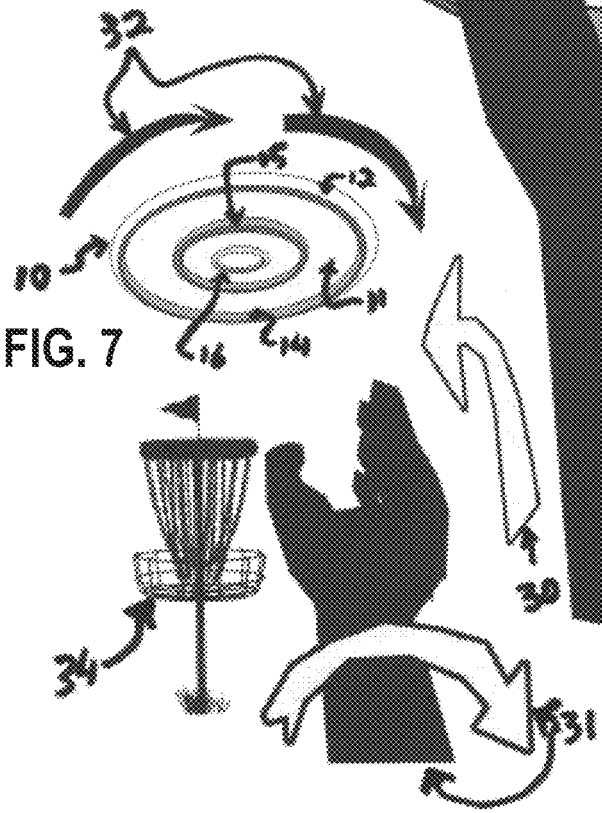
FIG. 7 depicts a release of the flying disc with forward arm motion and rotating spin movement of the hand creates flying disc rotation on release and spin of the flying disc, in accordance with some embodiments of the present disclosure. The flying disc moves directly at the flying disc target or an intended direction with the spin of the flying disc from the grip ring (larger circle). This is similar to throwing a baseball or football, so it should come naturally in ability to now launch the flying disc successfully in flight and more consistent accurate direction than other known ways to launch a flying disc. This would be reversed for left-handed flying disc throwers.
Figure 8:
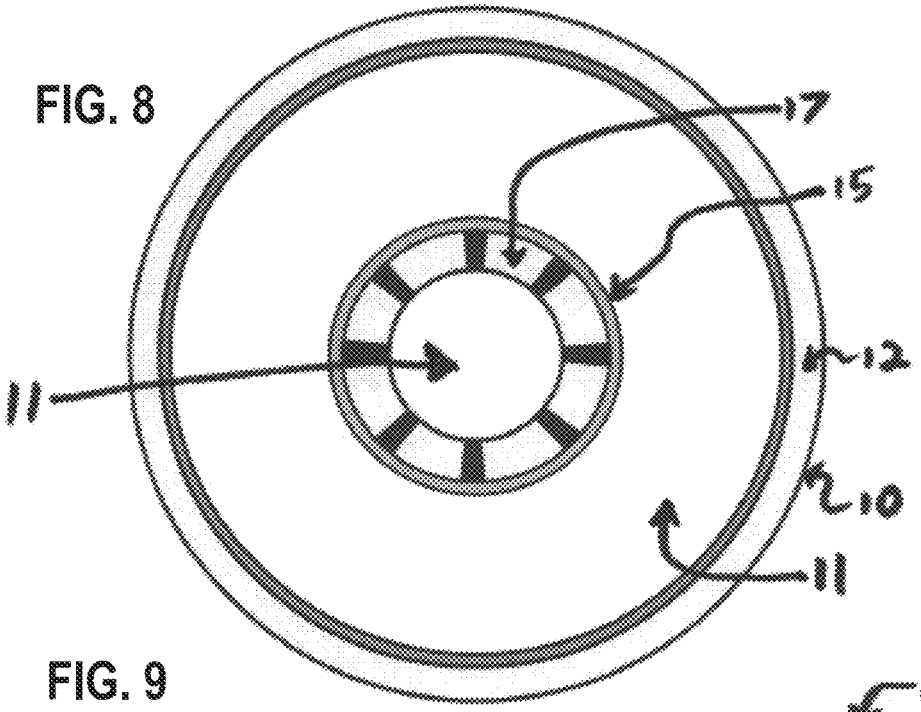
FIG. 8 depicts a bottom view of a foam type flying disc where a wider grip ring is reinforced with a thicker grip ring and is tapered toward the inner flying disc bottom flight plate, in accordance with some embodiments of the present disclosure. The foam type flying disc has this additional thicker grip ring area to facilitate and compensate the sponge grip tension. This is illustrated as a ring, however incorporating ribbed, curved, indented, texture, extensions of the grip ring areas is envisioned for other embodiments.
Figure 9:
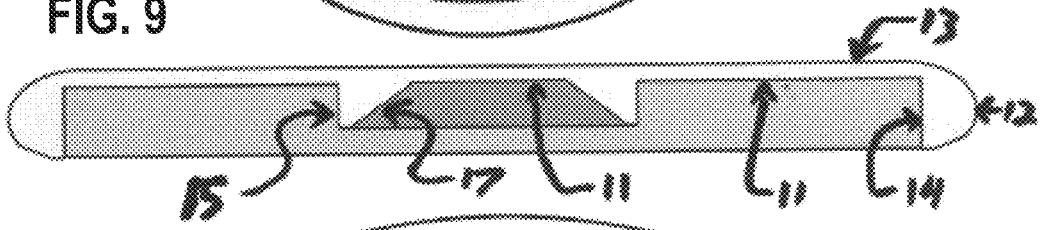
FIG. 9 depicts a side cross-sectional view of the foam type flying disc with thicker grip ring coming from the bottom of the flying disc flight plate to give resistance and facilitate and compensate support during gripping of this area, in accordance with some embodiments of the present disclosure. This grip ring size can vary in diameter, height, thickness and depth to facilitate the size of the flying disc or hand size of the thrower however centrally located under the flying disc bottom flight plate.

In some embodiments, the bottom flight plate structure 11 and the upstanding edge 12 form a circular recess 14 connecting to the bottom flight plate structure 11, with a centrally disposed grip ring (e.g., or raised structure from plate structure 11), illustrated as grip ring 15. In one embodiment, and as shown in FIG. 3, grip ring 15 extends from the bottom flight plate structure 11 that is illustrated in FIG. 6. This shows the hands thumb and fingers 29 gripping of the flying disc under the plate structure 11. Launching of the flying disc with forward arm motion 30 and the finger or hands rotating 31 and releasing of the flying disc rotating 32 and in the intended direction of travel and flight to target 34.

Figure 10:
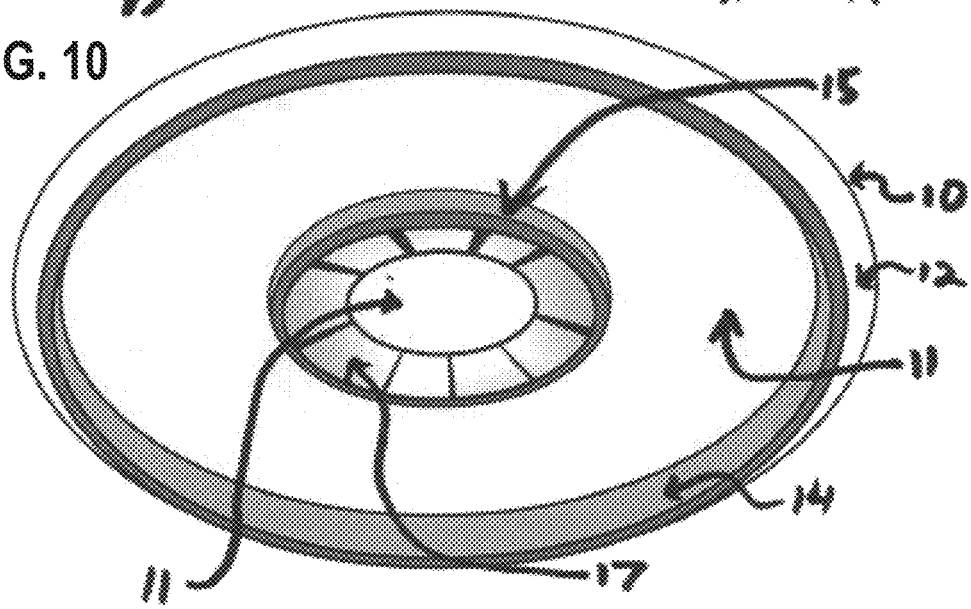
FIG. 10 depicts a perspective view of a bottom of the foam type flying disc with thicker grip ring coming from the bottom of the flying disc flight plate, in accordance with some embodiments of the present disclosure.
Figure 11:
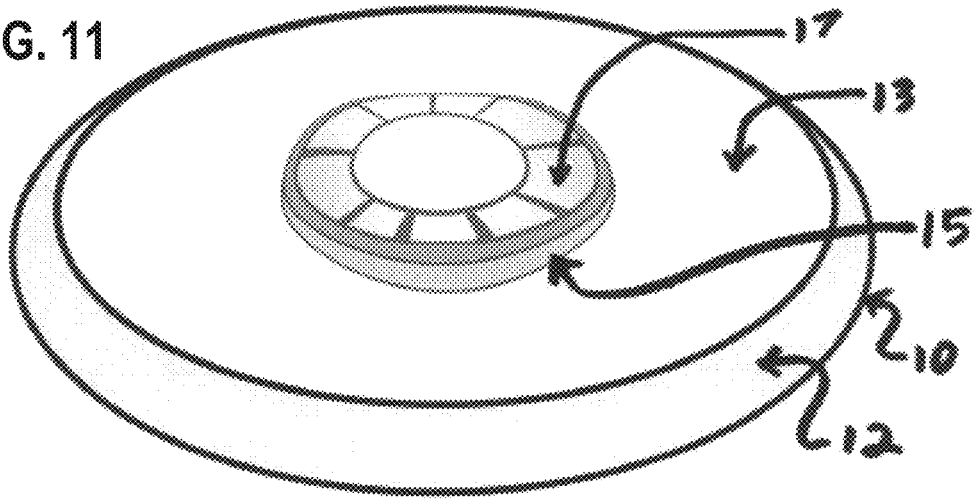
FIG. 11 depicts a perspective view of the foam type flying disc, with parts cut out so the thicker grip ring located under the flight plate on the bottom of the flying disc is shown, in accordance with some embodiments of the present disclosure.
Figure 12:
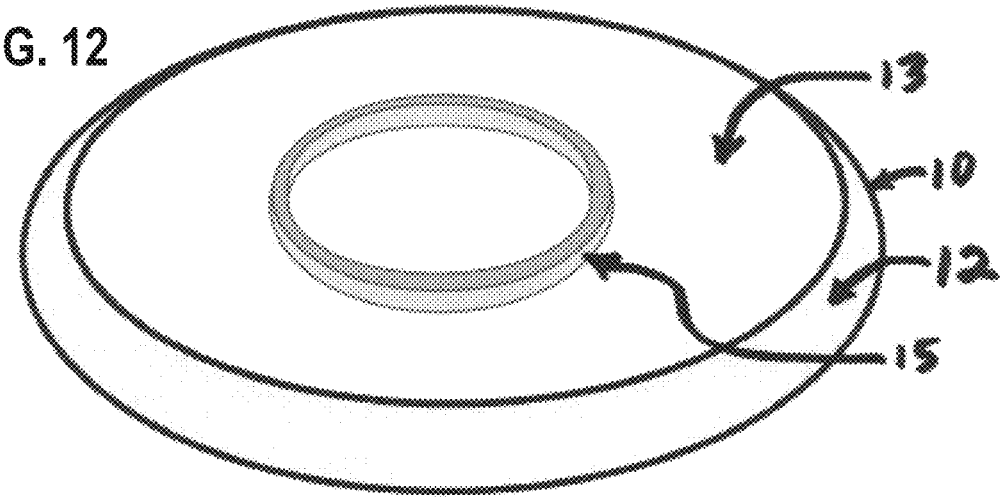
FIG. 12 depicts a perspective view of the top of a flying disc showing the single grip ring under the flight plate on the bottom of the flying disc, in accordance with some embodiments of the present disclosure.
Figure 21:
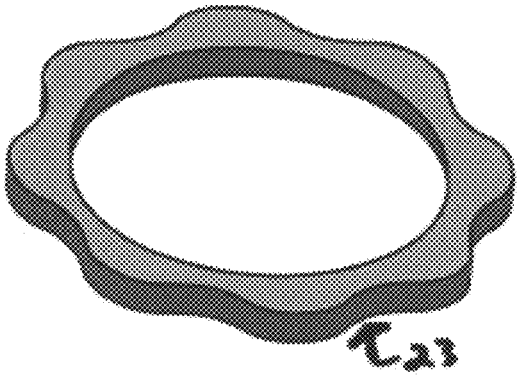
FIG. 21 depicts a perspective view of the enhanced grip ring cover (enlarged to show detail), in accordance with some embodiments of the present disclosure.
Figure 22:
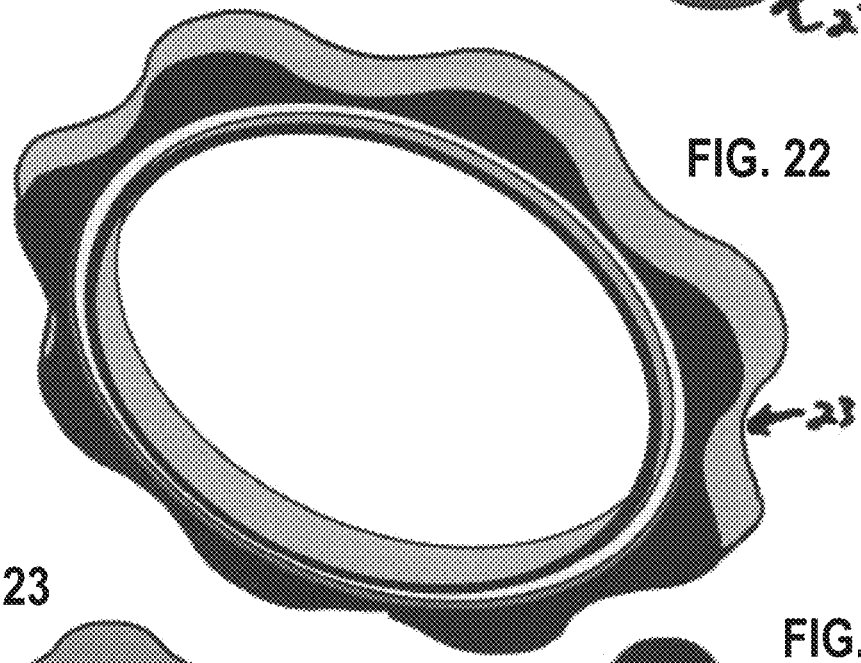
FIG. 22 depicts another perspective view of the enhanced grip ring cover with inner ringed cavity to be matched to the single grip ring (enlarged to show detail), in accordance with some embodiments of the present disclosure.
Figure 23:
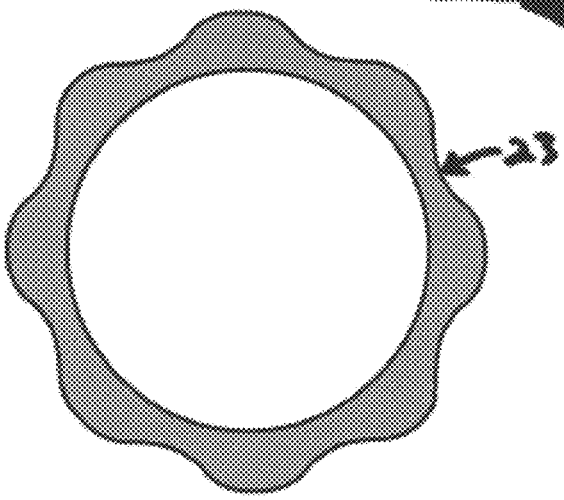
FIG. 23 depicts a top view of the enhanced grip ring cover (enlarged to show detail), in accordance with some embodiments of the present disclosure.
Figure 24:
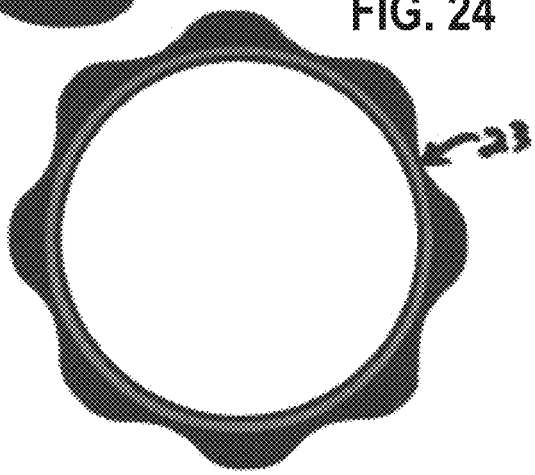
FIG. 24 depicts a bottom view of the enhanced grip ring cover showing the inner ringed cavity to be matched to the single grip ring (enlarged to show detail), in accordance with some embodiments of the present disclosure.
Figure 33:
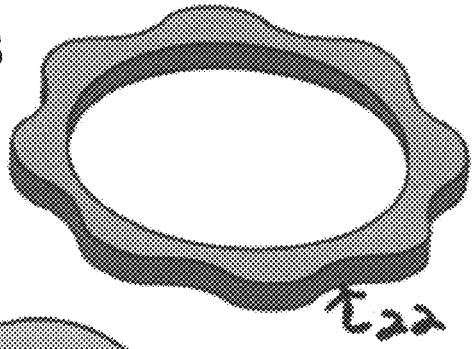
FIG. 33 depicts a perspective view of a top of the enhanced grip ring (enlarged to show detail), in accordance with some embodiments of the present disclosure.
Figure 34:
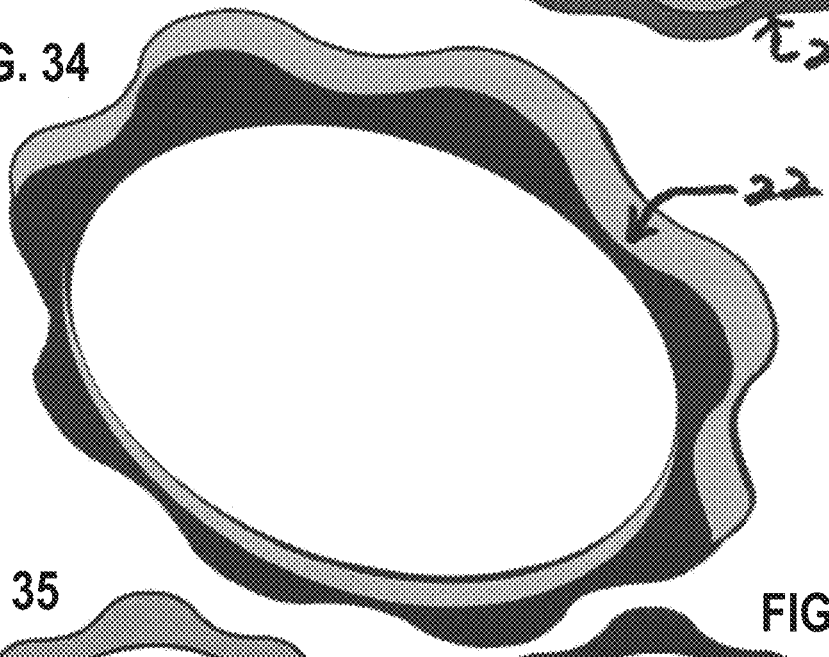
FIG. 34 depicts a perspective view of the bottom of the enhanced grip ring (enlarged to show detail), in accordance with some embodiments of the present disclosure.
Figure 35:
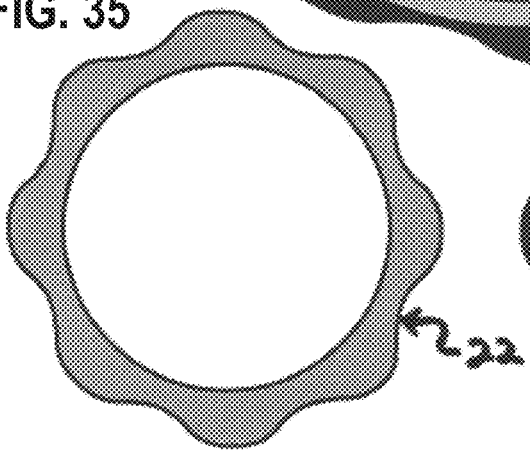
FIG. 35 depicts a top view of the enhanced grip ring (enlarged to show detail), in accordance with some embodiments of the present disclosure.
Figure 36:
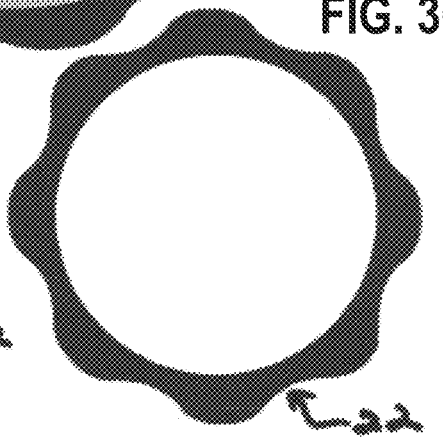
FIG. 36 depicts a bottom view of the enhanced grip ring (enlarged to show detail), in accordance with some embodiments of the present disclosure.
Figure 37:
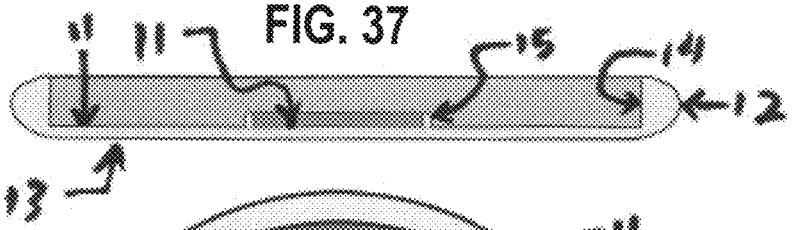
FIG. 37 depicts a side cross-sectional view of a flying disc with a single grip ring in center of a flying disc extending from bottom of a flying disc flight plate, in accordance with some embodiments of the present disclosure.
Figure 38:
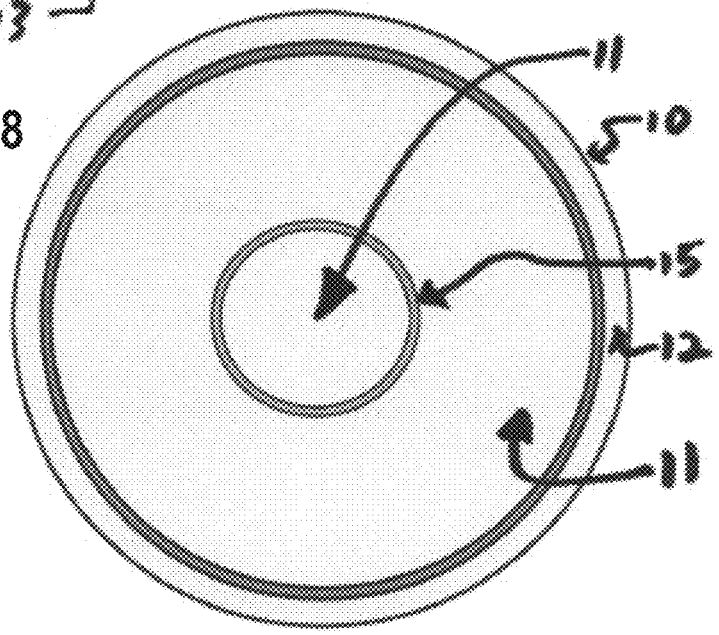
FIG. 38 depicts a bottom view of a flying disc with a single grip ring, in accordance with some embodiments of the present disclosure.
Figure 39:
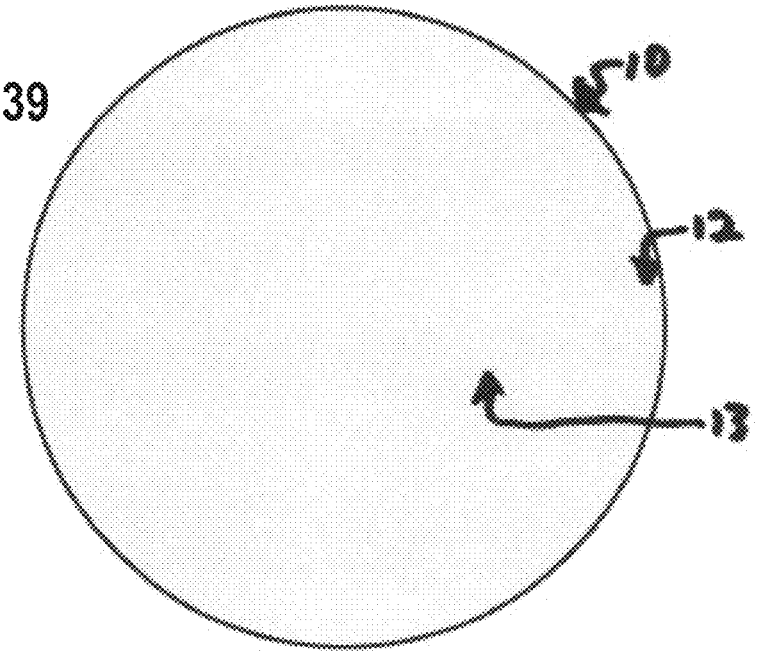
FIG. 39 depicts a top view of a flying disc, in accordance with some embodiments of the present disclosure.
Figure 40:
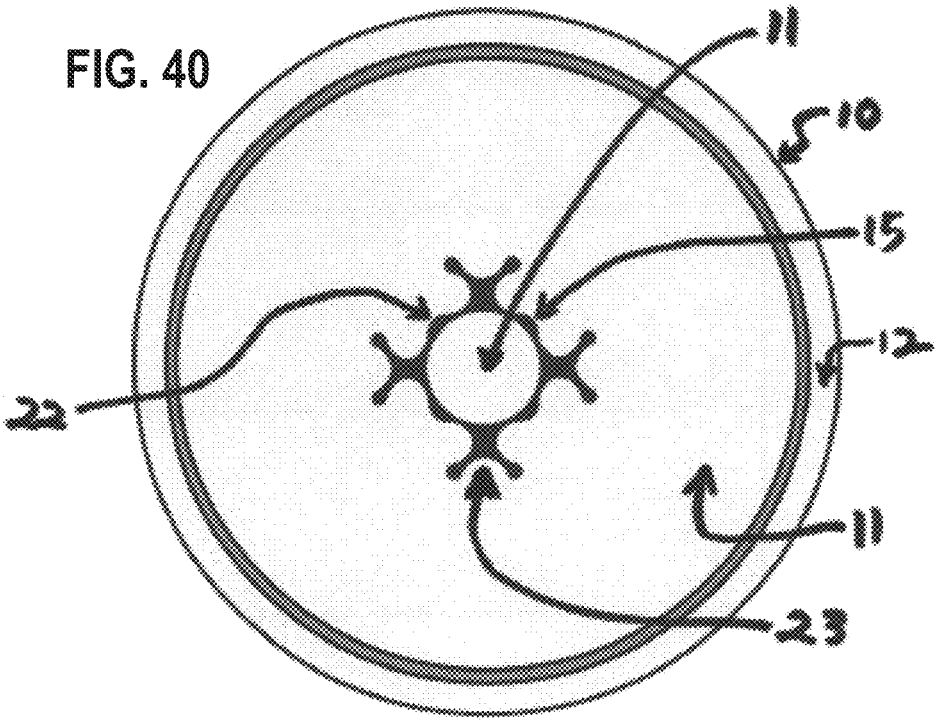
FIG. 40 depicts a bottom view of a flying disc, in accordance with some embodiments of the present disclosure. A grip ring or enhanced grip ring structure is an indented gear like structure that enhances multiple levels of gripping and edges for fingers and thumb placement to accelerate the control and spinning of the flying disc during launch. Such a structure as well as others can vary in height from the flying disc flight plate and radius or diameter size depending upon skill level of thrower or hand size. So, various discs are envisioned to accommodate such variables.
Figure 41:
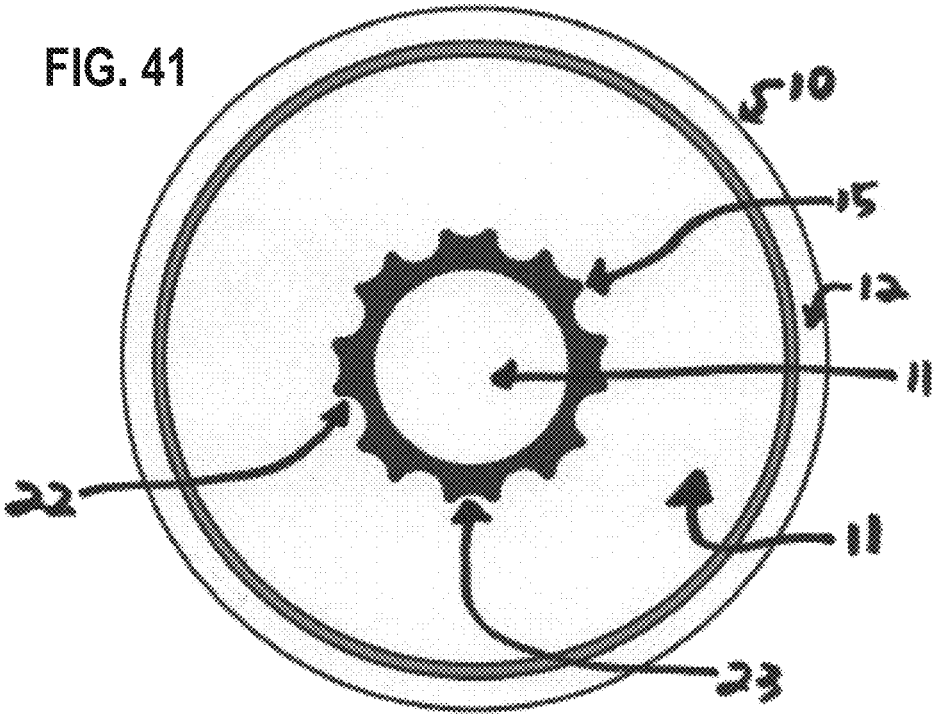
FIG. 41 depicts a bottom view of a flying disc, in accordance with some embodiments of the present disclosure. The grip ring or enhanced grip ring structure has features for two levels of gripping. This also facilitates use by various sized hands.
Figure 42:
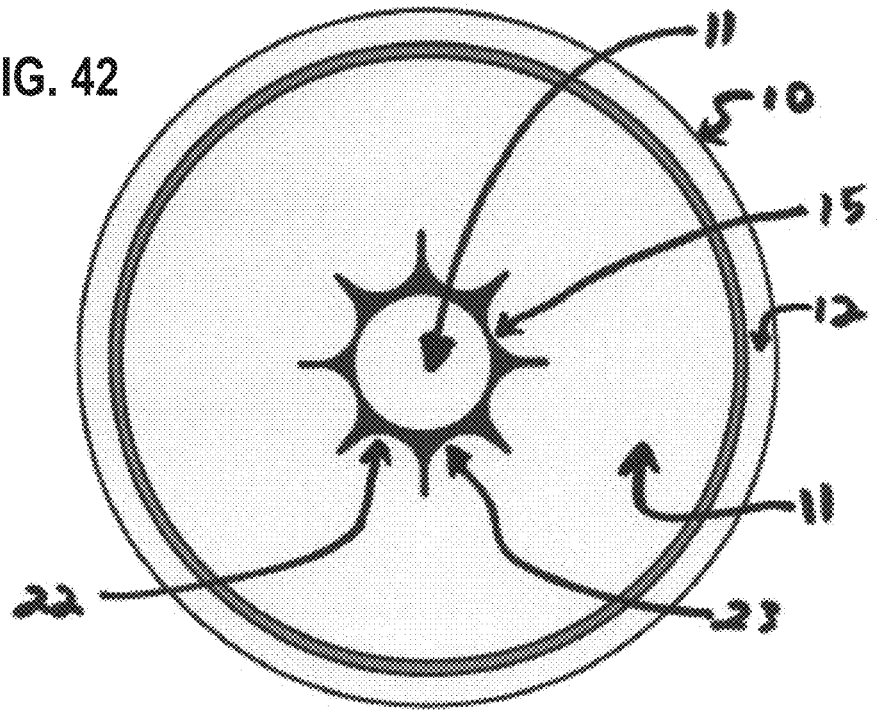
FIG. 42 depicts a bottom view of a flying disc, in accordance with some embodiments of the present disclosure. The grip ring or enhanced grip ring structure features longer grip ring elements of the grip ring extending towards the outer rim. This enhances gripping and edges for fingers and thumb placement to accelerate the control and spinning of the flying disc during launch.
Figure 43:
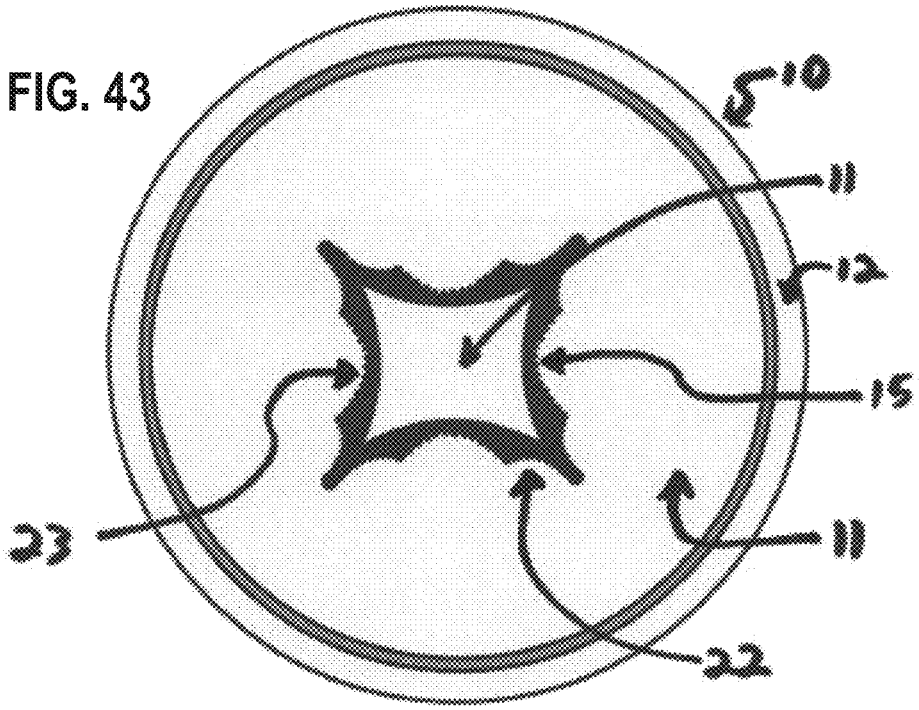
FIG. 43 depicts a bottom view of a flying disc, in accordance with some embodiments of the present disclosure. The grip ring or enhanced grip ring structure features four extended points that are ribbed and contoured for ease of gripping and facilitate easy flying disc rotation. This ribbed or texture can be incorporated in other embodiments of a flying discs grip rings even if not illustrated in the structures described herein.
Figure 44:
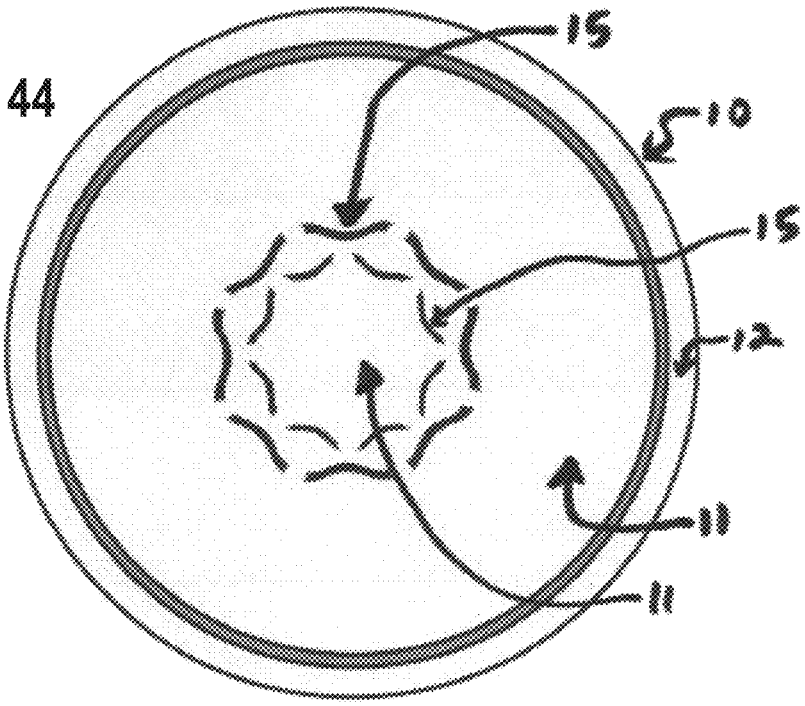
FIG. 44 depicts a bottom view of a flying disc, in accordance with some embodiments of the present disclosure. This drawing features curved contoured grip ring elements that are spaced in a double grip ring structure. This illustrates the open spacing that can occur in any flying disc grip rings embodiment even if not illustrated in the structures described herein.
Figure 45:
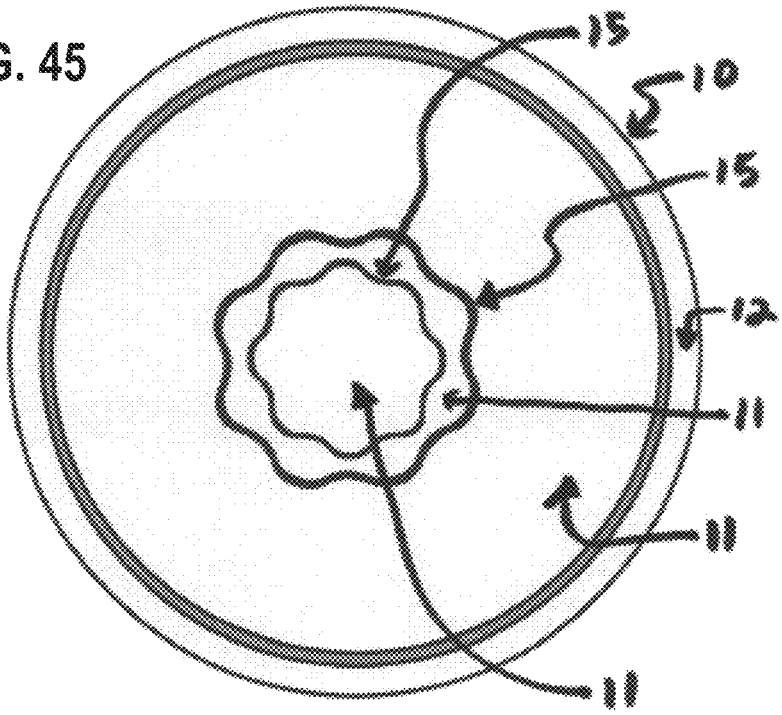
FIG. 45 depicts a bottom view of a flying disc, in accordance with some embodiments of the present disclosure. This drawing features curved contoured grip ring elements in a double grip ring structure.
Figure 60:
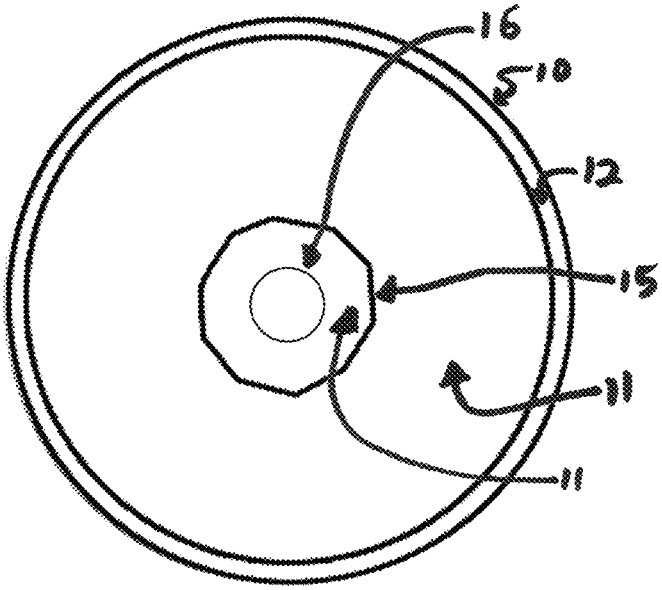
FIG. 60 depicts a bottom perspective view of a 3D flying disc featuring straight edged grip ring and molded center rim thumb ring, in accordance with some embodiments of the present disclosure.
Figure 61:
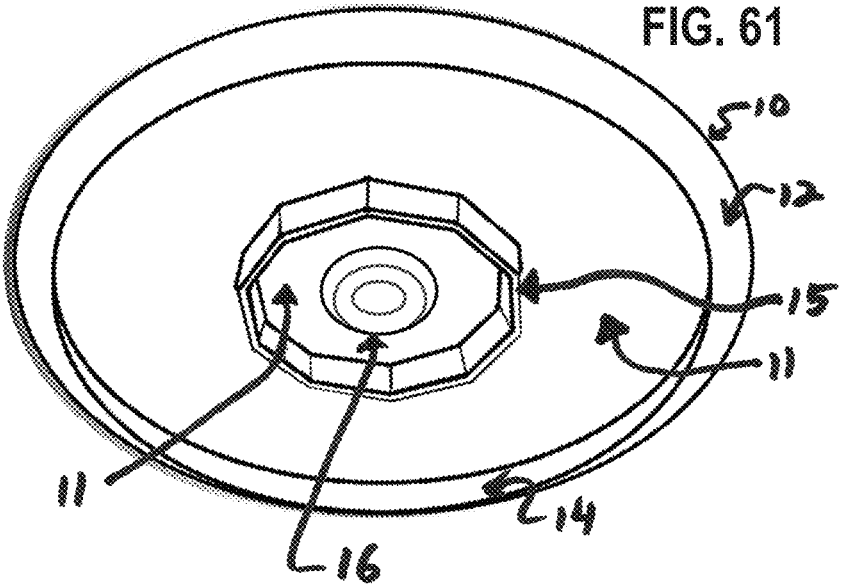
FIG. 61 depicts a perspective view of the bottom of a 3D flying disc featuring straight edged grip ring and molded center rim thumb ring, in accordance with some embodiments of the present disclosure.
Figure 62:
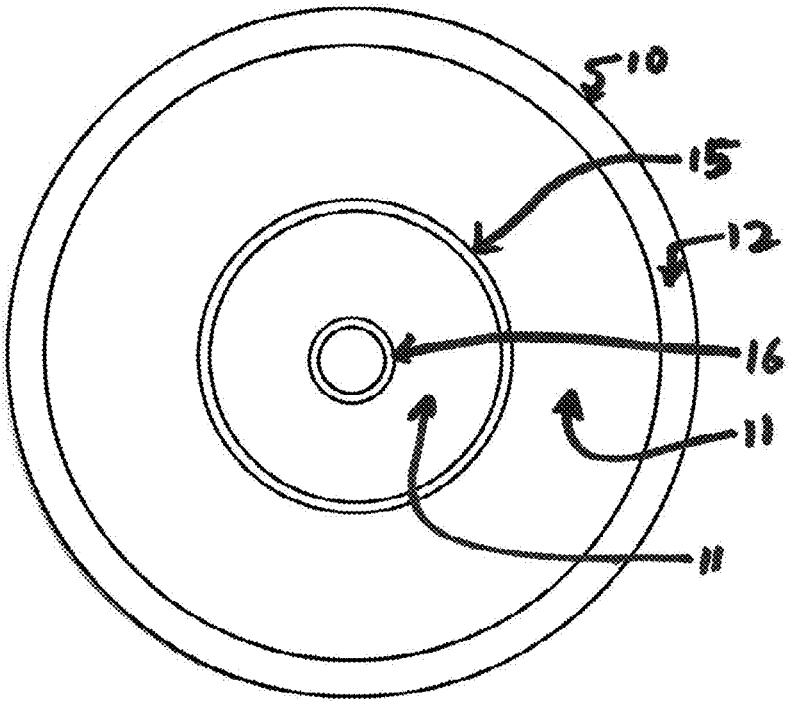
FIG. 62 depicts a bottom perspective view of a 3D foam type flying disc featuring grip ring and molded center rim thumb ring, in accordance with some embodiments of the present disclosure.
Figure 63:
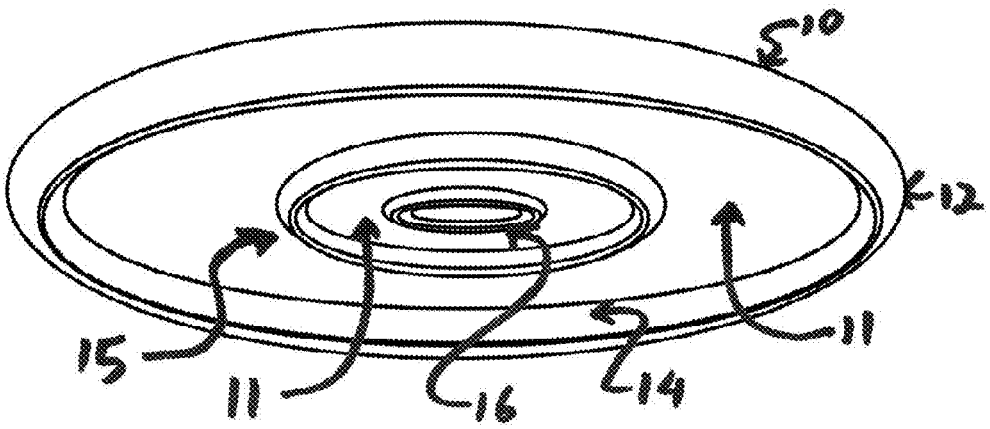
FIG. 63 depicts a perspective view of the bottom of a 3D foam type flying disc featuring grip ring and molded center rim thumb ring, in accordance with some embodiments of the present disclosure.
Figure 64:
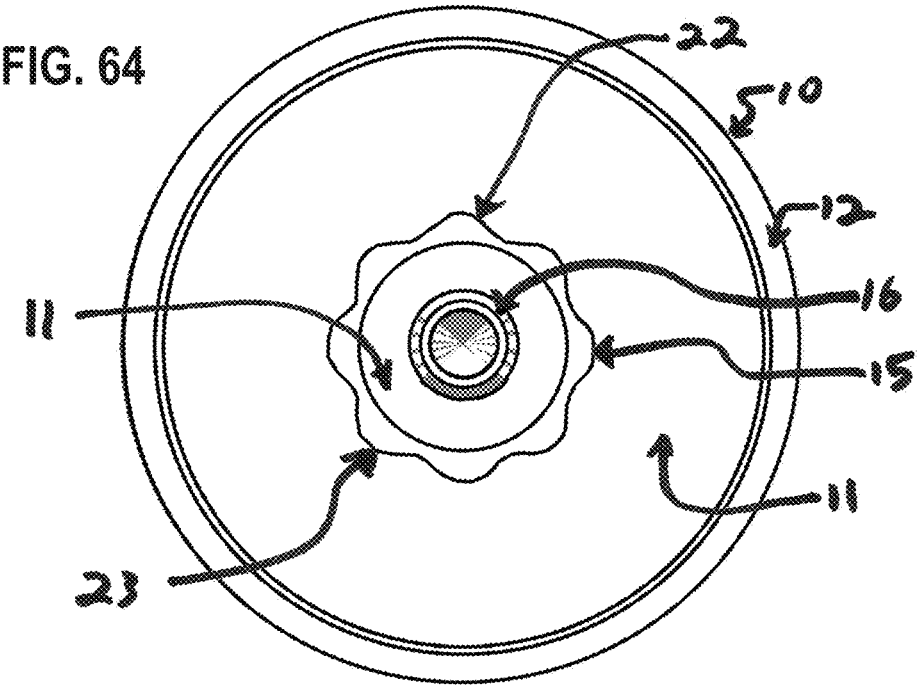
FIG. 64 depicts a bottom perspective view of a 3D flying disc featuring enhanced grip or grip ring and molded center rim thumb ring, in accordance with some embodiments of the present disclosure.
Figure 65:
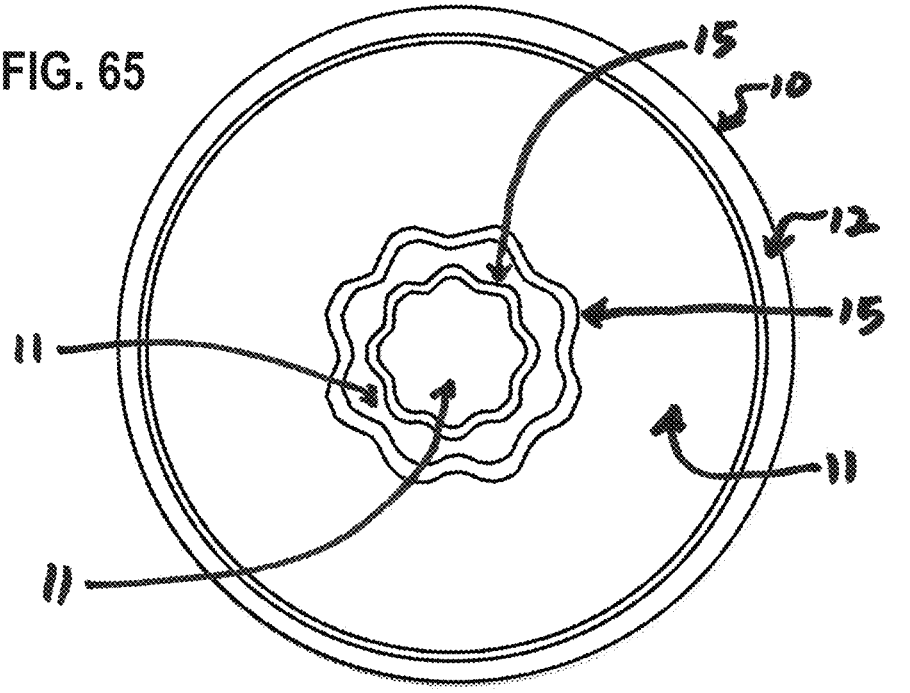
FIG. 65 depicts a bottom perspective view of a 3D flying disc featuring double grip ring, in accordance with some embodiments of the present disclosure.
Figure 66:
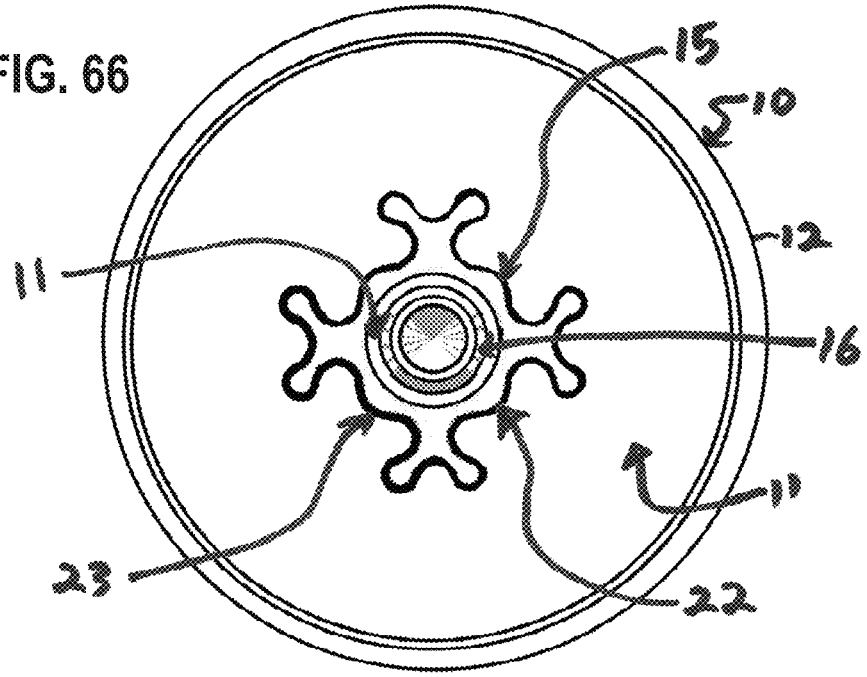
FIG. 66 depicts a bottom perspective view of a 3D flying disc featuring grip ring or enhanced grip ring structure and molded center rim thumb ring, in accordance with some embodiments of the present disclosure. This covers multiple levels of gripping and edges for fingers and thumb placement to accelerate the spinning of the flying disc with launch.
Figure 67:
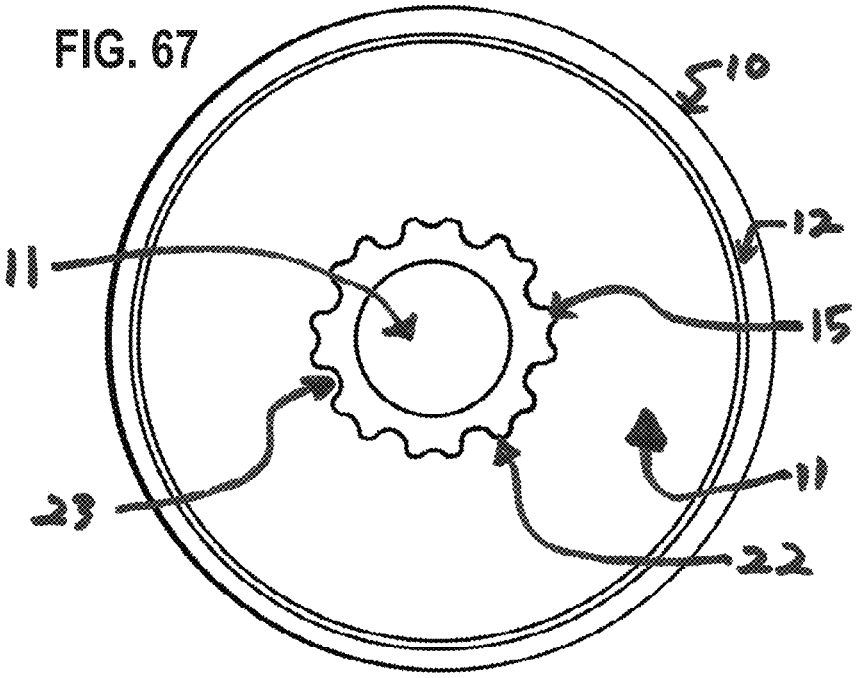
FIG. 67 depicts a bottom perspective view of a 3D flying disc featuring grip ring or enhanced grip ring structure that features two levels of gripping in a gear type structure, in accordance with some embodiments of the present disclosure.
Figure 68:
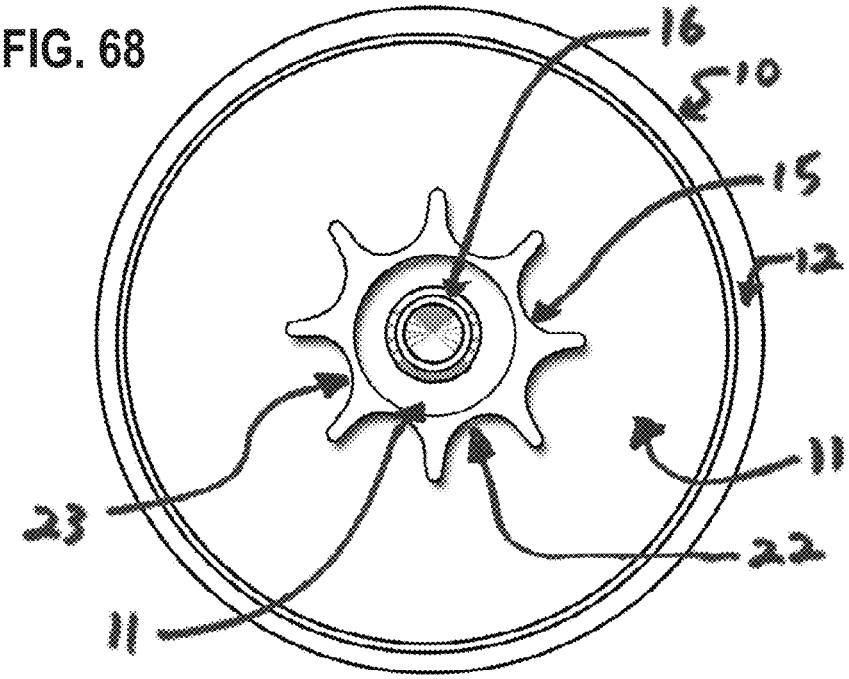
FIG. 68 depicts a bottom perspective view of a 3D flying disc featuring grip ring or enhanced grip ring structure that features longer grip ring elements of the grip ring extending towards the outer rim and molded center rim thumb ring, in accordance with some embodiments of the present disclosure.
Figure 69:
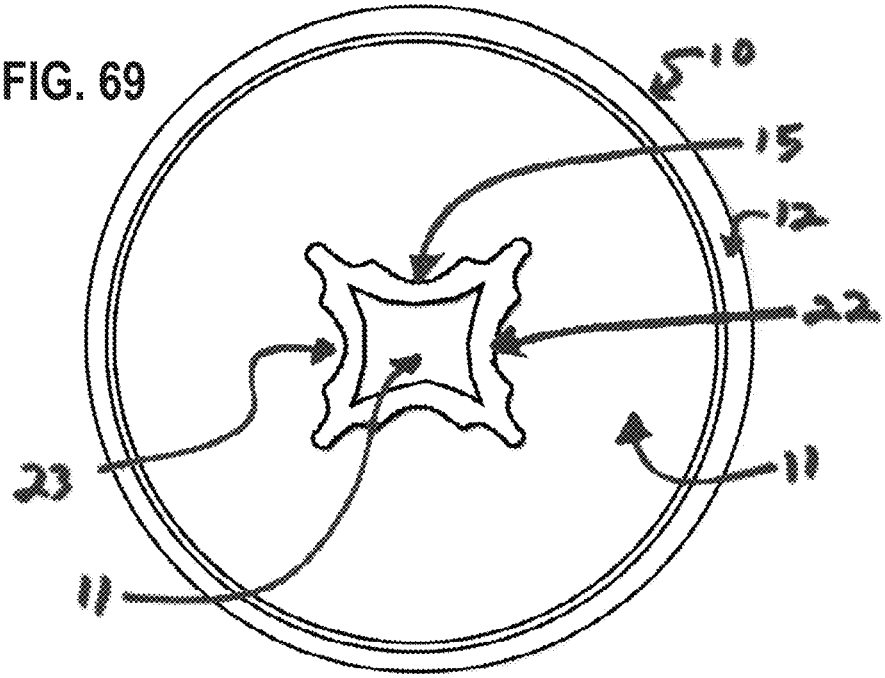
FIG. 69 depicts a bottom perspective view of a 3D flying disc featuring four extended point structure that are ribbed and contoured for ease of gripping and flying disc rotation, in accordance with some embodiments of the present disclosure.
Figure 70:
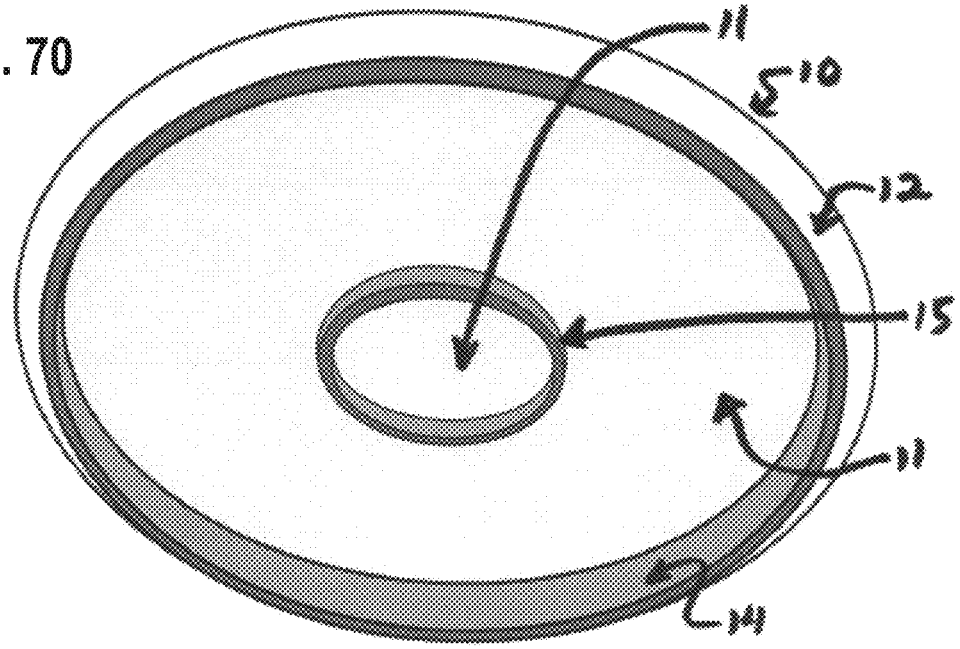
FIG. 70 depicts a bottom perspective view of a flying disc with a single grip ring under the flight plate on the bottom of the flying disc, in accordance with some embodiments of the present disclosure.
Figure 71:
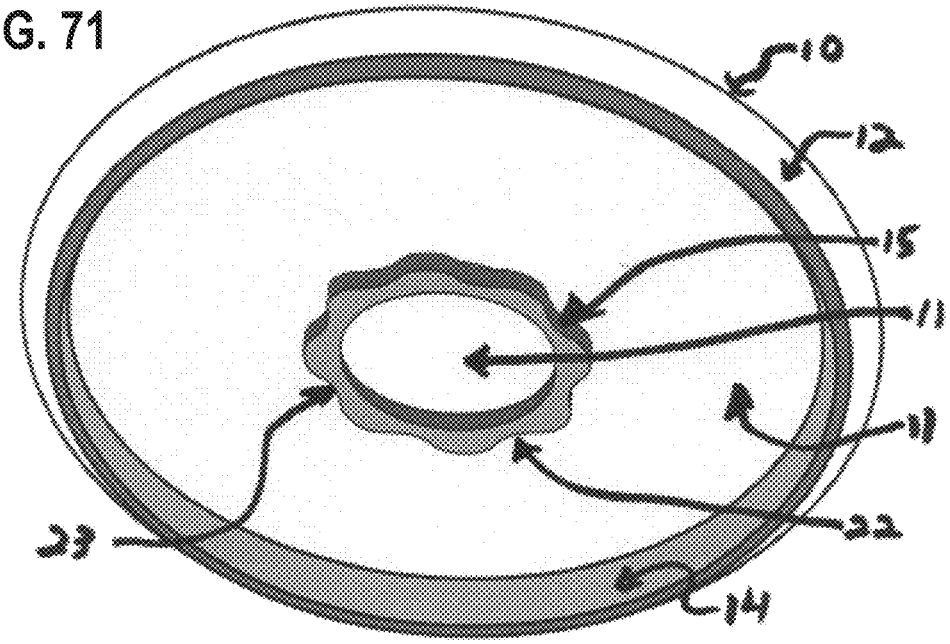
FIG. 71 depicts a bottom perspective view of the flying disc with enhanced grip or grip ring under flight plate on the bottom of the flying disc, in accordance with some embodiments of the present disclosure.

In some embodiments, and as shown in FIG. 10, the reinforced support for a resilient synthetic molded material composite type flying disc that gives the grip ring added support 17 (which can be foam or rubber). The flying disc 10 and launching the spinning motion of the flying disc (e.g., see disc rotating 32) in the accurate and an intended direction of the flying disc 10 and flight path target 34.

Figure 77:
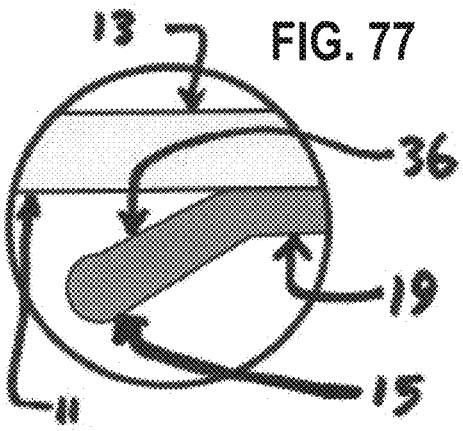
FIG. 77 depicts a partial side cross-sectional view of foam type flying disc with central inner durable flying disc device, in accordance with some embodiments of the present disclosure. This highlights the open air spacing from the grip ring and flying disc flight plate to enhance griping or control of the flying disc.
Figure 78:
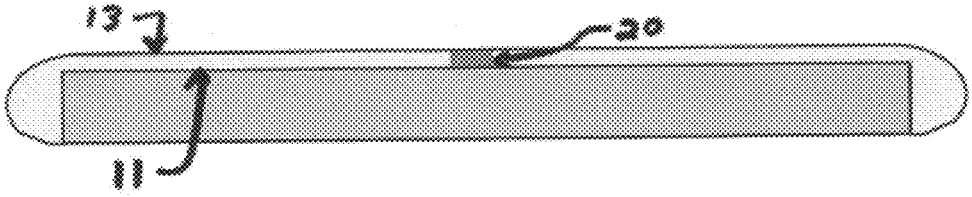
FIG. 78 depicts a side cross-sectional view of foam type flying disc, in accordance with some embodiments of the present disclosure.

In some embodiments, the flying disc 10 is a resilient synthetic molded material composite (e.g., including foam, rubber, or any combination thereof) that includes a centered inner durable flying disc device member, such as the bottom inner durable flying disc device 19 (which can be plastic), illustrated in FIG. 53, and shown is a cross section having various embodiments for improving the thumb placement on the thumb ring 16 and the grip ring 15. The inner durable flying disc device member comes together from two sections. Top cap retainer 18 and the bottom inner durable flying disc device 19 features the molded center rim with thumb ring 16 and grip ring 15. The top cap retainer 18 is female threaded and is attached through a flying disc opening 20, shown in FIG. 46, sandwiching the flying disc 10 with the bottom inner durable flying disc device 19 is illustrated in FIG. 53. The bottom inner durable flying disc device 19 has a male threaded center section 21, illustrated in FIG. 54. The bottom inner durable flying disc device 19, illustrated in FIG. 77, highlights the angled part 36 of the grip ring 15 of the inner durable flying disc device having open air between it and the plate structure 11 that allows for better gripping and control.

Figure 76:
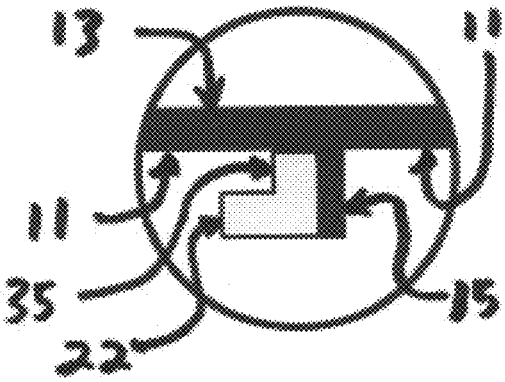
FIG. 76 depicts a partial side cross-sectional view of a flying disc with molded grip ring and enhanced grip ring attached to the molded grip ring, in accordance with some embodiments of the present disclosure. This highlights the open air spacing from the enhanced grip ring and flying disc flight plate that allows gripping around the enhanced grip ring. This enhanced grip ring can be made of plastic or softer materials.

In some embodiments, the flying disc 10 is a plastic material and the grip ring 15 is molded together in one piece FIG. 29. The flying disc 10 can have other material composites added and secured to the grip ring 15 for an enhanced grip ring 22, such as shown in FIG. 30, made of plastic or softer, rubber or different grip material of the flying disc 10 that is attached to the grip ring 15 outside edge by pressure, glue, or other securing methods, illustrated secured in FIG. 30. The outside edge of the enhanced grip ring 22 can be recessed having open air between the flying disc flight plate 35 to allow better gripping of the enhanced grip ring 22, such as illustrated in FIG. 76.

Figure 72:
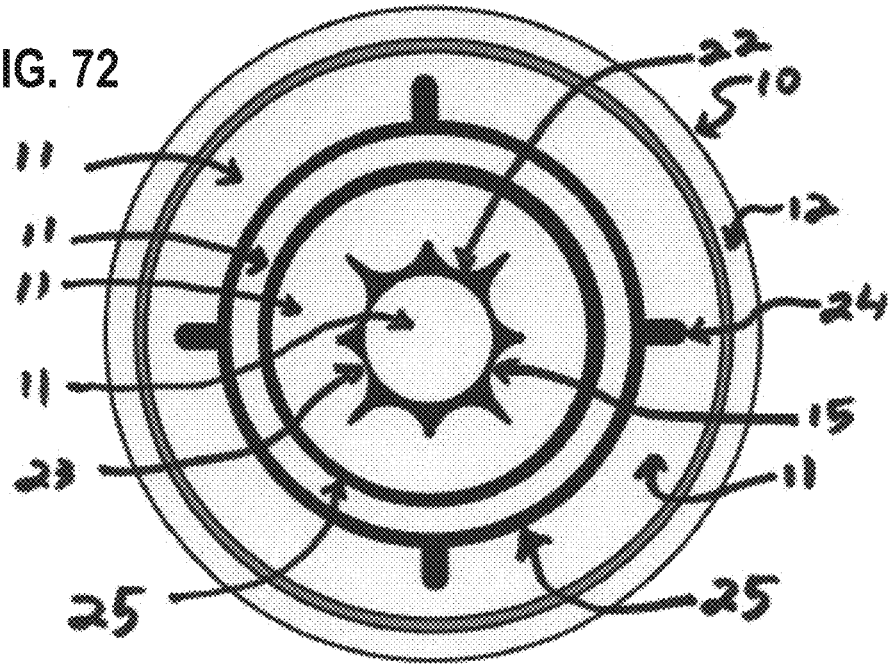
FIG. 72 depicts a bottom view of a flying disc featuring grip ring or enhanced grip ring structures that features a spoke curved elements extending towards the outer rim, in accordance with some embodiments of the present disclosure. It also features additional under the flight plate ring structures for stabilization of the flying disc and reduced aerodynamics to help limit flight dynamics.
Figure 73:
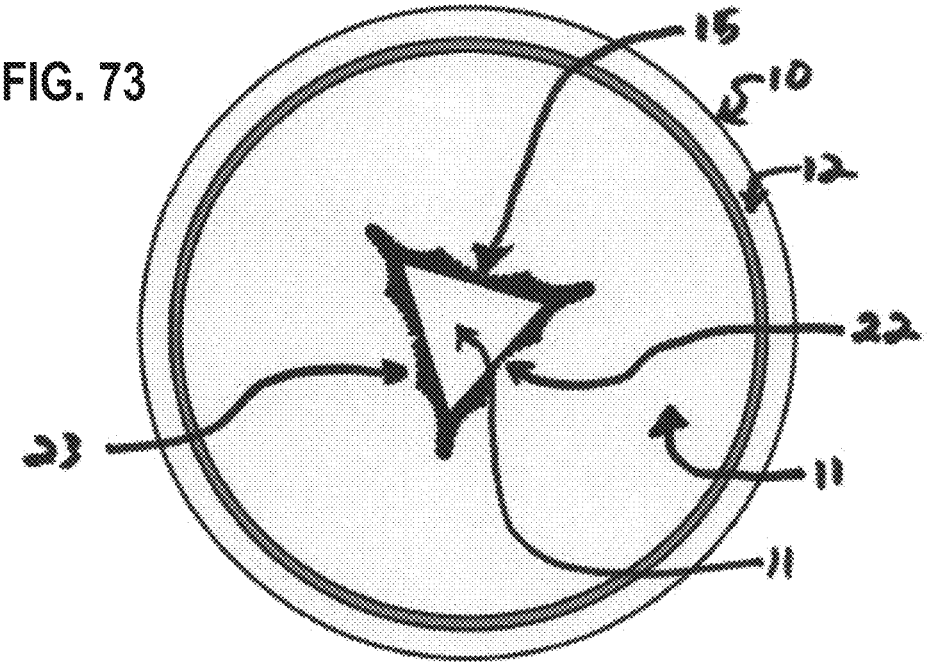
FIG. 73 depicts a bottom view of a flying disc featuring grip ring or enhanced grip ring structure that is more triangle in form, in accordance with some embodiments of the present disclosure. It features curved ribbed gripping areas for improved gripping and launching of a flying disc. These areas function and improve flying disc rotation elements off the fingers and thumb in launching the flying disc.
Figure 74:
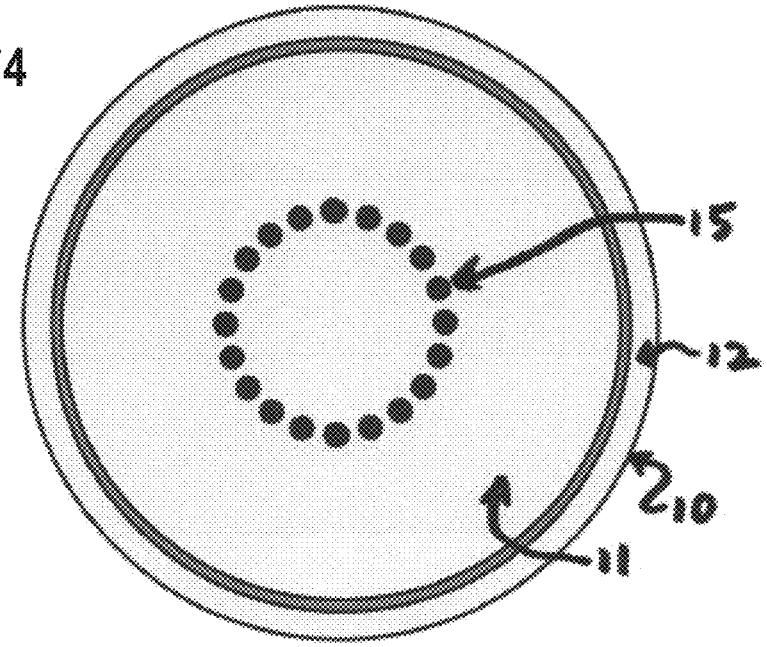
FIG. 74 depicts a bottom view of a flying disc featuring grip ring structure that is circular in form and made primarily of posts or tabs extending from the flight plate, in accordance with some embodiments of the present disclosure. This allows less air resistance and still allows the grip ring capability. The posts can be of different shapes or ribbed texture for added gripping capabilities and can vary in size diameter and circumference based upon hand size or flying disc size. Height of the posts can also vary as a thrower or player can choose a flying disc with less height or more depending on skill level of thrower.
Figure 75:
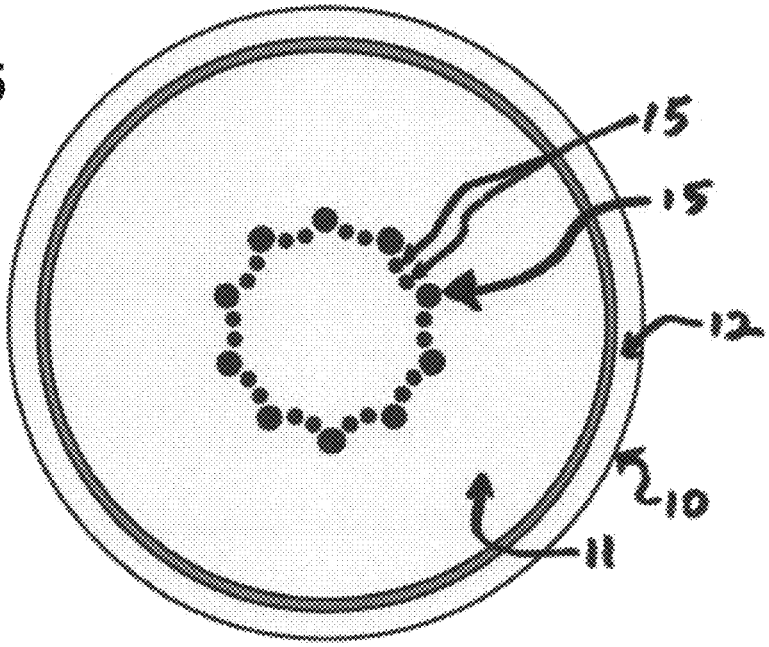
FIG. 75 depicts a bottom view of a flying disc featuring grip ring structure that is mostly circular in form with indention for better grip and made primarily of posts or tabs extending from the flight plate, in accordance with some embodiments of the present disclosure. This can be of different shapes in various diameters for grip ring giving less air resistance in flight and still allowing the grip ring capability.

In some embodiments, the flying disc 10 is a plastic material and the grip ring 15 is molded together in one piece. The flying disc 10 can have other material composites added and secured to the grip ring 15 for an enhanced grip ring cover 23, as shown in FIG. 18, made with plastic, or softer, rubber or different grip material of the flying disc 10 that attached to the grip ring 15 by pressure, glue, or other securing methods, such as illustrated as secured in FIG. 18. In some embodiments, the flying disc 10 and under the plate structure 11 the grip ring 15 structure can also have additional flight reduction structures 24 or flight stabilization rings or structures 25, such as shown added and illustrated in FIG. 72. Some embodiments employ a flying disc-shaped toy, for example, a flexible flying disc-shaped toy formed of a resilient synthetic molded material composite (e.g., including foam, rubber, or any combination thereof) which can be molded in an integral, saucer-like configuration. The resilient molded material composite provides a cushioning effect when the flying disc shaped toy is thrown and caught; thus, making it safe and easier to catch. Embodiments of the disc-shaped toy provide an aerial projectile having aerodynamic flight characteristics which makes it suitable for use as an aerial toy, flying disc. An edge of the flying disc possesses a sufficient thickness for providing greater durability and stability in flight, as well as being easier to catch. Methods for throwing a flying disc includes a grip ring molded or inner durable flying disc device located under bottom of a flying disc flight plate for control and handling creating flying disc rotation and accurate direction of disc flight similar to throwing a baseball or football.

Some embodiments of the flying disc can have a skin or fabric covering upon which decorative patterns and other indicia can be imprinted for enabling the flying disc to be used as an advertising novelty. The skin or fabric can be water resistant and possess buoyant characteristics that allow the foam type flying disc to be used in water sports or as a pool toy. The buoyant characteristics of the foam type flying disc are such that when the foam type flying disc is floating in water, a portion of the foam type flying disc extends above the water.

Some embodiments feature utility capabilities for flying discs to be handled and thrown from under the flying disc with symmetrical ring structures under the flight plate. These substantial symmetrical inner grip ring areas supply the ability for anyone to grab, grip and launch the flying disc with a spin in the intended direction and accurately achieve the intended direction as easily as throwing a baseball or football. This is a huge advancement in flying discs to utilize the flying disc with one's hand from below the flying disc for launching of the flying disc flight more accurately in the intended direction to a receiving catcher, or disc golf basket, target. The learning curve to launch a flying disc is reduced and beginner to pro will appreciate the ease of use and enhanced control of the flying disc flight and achieving the intended direction.

Some embodiments of the flying disc or methods thereof utility feature capabilities for flying discs to be handled and thrown from under the flying disc with utility ring structures under the flight plate. These substantial symmetrical inner grip ring areas supply the ability for anyone to grab, grip and launch the flying disc with a spin in the intended direction and accurately achieve the intended direction as easily as throwing a baseball or football. Incorporating these ring structures and additional wind reducing structures will help slow down the flying disc distance for more stable flights and reduction in desired aerodynamics distance for flying discs used as flying disc putters for disc golf.

Reference throughout this specification to "some embodiments", "one embodiment", "an embodiment", or "a specific embodiment" means that a particular feature, structure, or characteristic described in connection with the embodiment is included in at least one embodiment of the present invention and not necessarily in all its embodiments. Therefore, the respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Some embodiments of the flying disc or of methods thereof include a thumb ring centrally located under flying disc flight plate for the placement of a thumb to facilitate the grip resistance from the center of disc and fingers simultaneously with equal pressure on the flying disc edge. This allows one to easily securely and accurately launch the flying disc with finger movement creating spin on the edge of the flying disc and rotation on thumb withing thumb ring. The forward snap of the arm or hand allows accurate throwing of the flying disc in an intended direction and controlled flight.

Additionally, any arrows in the drawings or figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of the illustrated embodiments of the present invention and are to be included within the spirit and scope of the present invention.

Therefore, while the present invention has been described herein with reference to the particular embodiments thereof, a latitude of modification, various changes and substitutions are intended in the foregoing disclosures, and it will be appreciated that in some instances some features of the embodiments of the invention will be employed without the corresponding use of other features without departing from the scope and spirit of the invention as set forth. Therefore, many modifications may be made to adapt a particular situation or material to the essential scope and spirit of the present invention. It is intended that the invention not be limited to the particular terms used in claims or to the particular embodiment disclosed as the best mode contemplated for carrying out this invention, but that the invention will include any and all embodiments and equivalents falling within the scope of the future appended claims.

What is claimed is:

1. An apparatus, comprising:

a disc having a bottom structure and an upstanding edge included with and circumscribing the bottom structure to form a recess; and an inner central structure underneath the bottom structure at a central portion of the disc, wherein the inner central structure comprises a plurality of additional structures protruding downwardly from the bottom structure and configured to provide gripping of the apparatus from under the apparatus, and wherein the plurality of additional structures comprises an outside edge that is recessed to enhance the gripping of the apparatus from under the apparatus.

2. The apparatus of claim 1, wherein the inner central structure comprises a ring protruding downwardly from the bottom structure and is configured to provide gripping of the apparatus from under the apparatus.

3. The apparatus of claim 2, wherein the ring includes edging, texture, recesses, tabs, posts, curves, ribbing, or any combination thereof to improve grip and assist in easier rotation of the apparatus during a launch the apparatus.

4. The apparatus of claim 1, wherein the disc comprises foam.

5. The apparatus of claim 4, wherein the inner central structure comprises foam.

6. The apparatus of claim 5, further comprising a thumb ring configured to receive a thumb of a person when the person grips the apparatus, and wherein the thumb ring comprises foam.

7. The apparatus of claim 1, wherein the disc comprises rubber.

8. The apparatus of claim 1, wherein the inner central structure comprises rubber.

9. The apparatus of claim 1, wherein the disc comprises plastic.

10. The apparatus of claim 1, wherein the inner central structure comprises plastic.

11. The apparatus of claim 1, further comprising a thumb ring configured to receive a thumb of a person when the person grips the apparatus, and wherein the thumb ring is underneath the bottom structure.

12. The apparatus of claim 11, wherein the thumb ring is within the inner central structure.

13. The apparatus of claim 12, wherein the thumb ring is at a central portion of the inner central structure.

14. The apparatus of claim 11, wherein the thumb ring comprises rubber.

15. An apparatus, comprising:

a disc having a bottom structure and an upstanding edge included with and circumscribing the bottom structure to form a recess; and an inner central structure underneath the bottom structure at a central portion of the disc, wherein the inner central structure comprises an additional structure protruding downwardly from the bottom structure and configured to provide gripping of the apparatus from under the apparatus, and wherein the additional structure comprises an outside edge that is recessed to enhance the gripping of the apparatus from under the apparatus.

16. The apparatus of claim 15, wherein the additional structure includes edging, texture, recesses, tabs, posts, curves, ribbing, or any combination thereof to improve grip and assist in easier rotation of the apparatus during a launch the apparatus.

17. The apparatus of claim 15, wherein the inner central structure comprises a ring protruding downwardly from the bottom structure and is configured to provide gripping of the apparatus from under the apparatus.

18. The apparatus of claim 17, wherein the ring includes edging, texture, recesses, tabs, posts, curves, ribbing, or any combination thereof to improve grip and assist in easier rotation of the apparatus during a launch the apparatus.

19. A apparatus, comprising:

a disc having a bottom structure and an upstanding edge included with and circumscribing the bottom structure to form a recess; and an inner central structure underneath the bottom structure at a central portion of the disc, wherein the inner central structure comprises a plurality of additional structures protruding downwardly from the bottom structure and configured to provide gripping of the apparatus from under the apparatus, wherein the plurality of additional structures comprises an outside edge that is recessed to enhance the gripping of the apparatus from under the apparatus, and wherein the inner central structure comprises a ring protruding downwardly from the bottom structure.

20. The apparatus of claim 19, wherein the ring includes edging, texture, recesses, tabs, posts, curves, ribbing, or any combination thereof to improve grip and assist in easier rotation of the apparatus during a launch the apparatus.

* * * * *